US012667758B2

(12) United States Patent
Milleman et al.

(10) Patent No.: US 12,667,758 B2
(45) **Date of Patent: *Jun. 30, 2026**

(54) MULTI-COMPONENT GOLF CLUB HEAD

(71) Applicant: KARSTEN MANUFACTURING CORPORATION, Phoenix, AZ (US)

(72) Inventors: Travis D. Milleman, Cave Creek, AZ (US); Clayson C. Spackman, Scottsdale, AZ (US); Cory S. Bacon, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 143 days.

This patent is subject to a terminal disclaimer.

(21) Appl. No.: 18/535,849

(22) Filed: Dec. 11, 2023

(65) Prior Publication Data

US 2024/0131404 A1 Apr. 25, 2024

Related U.S. Application Data

(63) Continuation of application No. 17/175,558, filed on Feb. 12, 2021, now Pat. No. 11,839,802, which is a (Continued)

(51) Int. Cl.
*A63B 53/08* (2015.01)
*A63B 1/00* (2006.01)
(Continued)

(52) U.S. Cl.
CPC ..... *A63B 53/08* (2013.01); *A63B 1/00* (2013.01); *A63B 53/06* (2013.01);
(Continued)

(58) Field of Classification Search
CPC ..... A63B 53/08; A63B 53/06; A63B 53/0433; A63B 53/0412; A63B 53/0466;
(Continued)

(56) References Cited

U.S. PATENT DOCUMENTS 5,624,331 A 4/1997 Lo
5,997,415 A 12/1999 Wood
(Continued)

FOREIGN PATENT DOCUMENTS

CN 1654100 8/2005
JP 2004024734 1/2004
(Continued)

OTHER PUBLICATIONS

Jason Bruno, TaylorMade ('17) M1 Driver Review, accessed Sep. 14, 2017.
(Continued)

*Primary Examiner* — Sebastiano Passaniti

(57) ABSTRACT

Embodiments of wood-type club heads comprising one or more components are described herein. The wood-type club head comprises a first, metallic component, and a second, non-metallic component. The first component comprises the load bearing structure that forms the striking face, and portions of the crown, the heel, the toe, and the sole. The second component comprises a lightweight structure that wraps around the first component to form portions of the crown, the heel, the toe, and the sole. The first component comprises the majority of the club head mass and can receive removable weights. The two-component design allows for additional discretionary mass redistribution to improve center of gravity location and moment of inertia.

20 Claims, 15 Drawing Sheets

Related U.S. Application Data continuation-in-part of application No. 17/105,459, filed on Nov. 25, 2020, now Pat. No. 11,517,799, which is a continuation-in-part of application No. PCT/US2020/047702, filed on Aug. 24, 2020, and a continuation-in-part of application No. PCT/US2020/043483, filed on Jul. 24, 2020, and a continuation-in-part of application No. 16/789,261, filed on Feb. 12, 2020, now Pat. No. 10,953,294, which is a continuation of application No. 16/215,474, filed on Dec. 10, 2018, now Pat. No. 10,596,427.

(60) Provisional application No. 63/015,398, filed on Apr. 24, 2020, provisional application No. 62/976,229, filed on Feb. 13, 2020, provisional application No. 62/975,631, filed on Feb. 12, 2020, provisional application No. 62/940,799, filed on Nov. 26, 2019, provisional application No. 62/891,158, filed on Aug. 23, 2019, provisional application No. 62/878,263, filed on Jul. 24, 2019, provisional application No. 62/596,677, filed on Dec. 8, 2017.

(51) Int. Cl.

| | |
|---|---|
| ***A63B 53/04*** | (2015.01) |
| ***A63B 53/06*** | (2015.01) |
| ***A63B 102/32*** | (2015.01) |
| *A63B 60/54* | (2015.01) |

(52) U.S. Cl.

CPC ..... *A63B 53/0412* (2020.08); *A63B 53/0433* (2020.08); *A63B 53/045* (2020.08); *A63B 53/0466* (2013.01); *A63B 2053/0491* (2013.01); *A63B 60/54* (2015.10); *A63B 2102/32* (2015.10); *A63B 2209/023* (2013.01)

(58) Field of Classification Search

CPC ..... A63B 60/54; A63B 2053/0491; A63B 2209/023; A63B 53/045

USPC ..... 473/324–350, 287–292, 255

See application file for complete search history.

(56) References Cited

U.S. PATENT DOCUMENTS

| | | | | |
|---|---|---|---|---|
| 6,471,604 | B2 | 10/2002 | Hocknell | |
| 6,558,271 | B1 | 5/2003 | Beach | |
| 6,572,491 | B2 | 6/2003 | Hasebe | |
| 6,575,845 | B2 | 6/2003 | Galloway | |
| 6,663,504 | B2 | 12/2003 | Hocknell | |
| 6,739,983 | B2 | 5/2004 | Helmstetter | |
| 6,872,152 | B2 | 3/2005 | Beach | |
| 6,875,129 | B2 | 4/2005 | Erickson | |
| 6,929,565 | B2 | 8/2005 | Nakahara | |
| 6,945,877 | B2 | 9/2005 | Kobayashi | |
| 6,955,612 | B2 | 10/2005 | Lu | |
| 7,025,692 | B2 | 4/2006 | Erickson | |
| 7,074,136 | B2 | 7/2006 | Noguchi | |
| 7,121,957 | B2 | 10/2006 | Hocknell | |
| 7,128,664 | B2 | 10/2006 | Onoda | |
| 7,147,576 | B2 | 12/2006 | Imamoto | |
| 7,258,625 | B2 | 8/2007 | Kawaguchi | |
| 7,261,645 | B2 | 8/2007 | Oyama | |
| 7,285,060 | B2 | 10/2007 | Williams | |
| 7,316,624 | B2 | 1/2008 | Sanchez | |
| 7,338,390 | B2 | 3/2008 | Lindsay | |
| 7,377,861 | B2 | 5/2008 | Tateno | |
| 7,387,577 | B2 | 6/2008 | Murphy | |
| 7,445,564 | B2 | 11/2008 | Kusumoto | |
| 7,455,600 | B2 | 11/2008 | Imamoto | |
| 7,468,005 | B2 | 12/2008 | Kouno | |
| 7,497,789 | B2 | 3/2009 | Burnett | |
| 7,530,901 | B2 | 5/2009 | Imamoto | |
| 7,530,903 | B2 | 5/2009 | Imamoto | |
| 7,578,756 | B2 | 8/2009 | Erickson | |
| 7,601,078 | B2 | 10/2009 | Mergy | |
| 7,632,195 | B2 | 12/2009 | Jorgensen | |
| 7,758,454 | B2 | 7/2010 | Burnett | |
| 7,785,212 | B2 | 8/2010 | Lukasiewicz, Jr. | |
| 7,806,782 | B2 | 10/2010 | Stites | |
| 7,871,339 | B2 | 1/2011 | Sanchez | |
| 7,887,434 | B2 | 2/2011 | Beach | |
| 7,931,546 | B2 | 4/2011 | Bennett | |
| 7,959,522 | B2 | 6/2011 | North, III | |
| 8,012,038 | B1 | 9/2011 | Beach | |
| 8,025,591 | B2 | 9/2011 | De La Cruz | |
| 8,100,781 | B2 | 1/2012 | Burnett | |
| 8,182,365 | B2 | 5/2012 | Wada | |
| 8,506,421 | B2 | 8/2013 | Stites | |
| 8,540,588 | B2 | 9/2013 | Rice | |
| 8,585,514 | B2 | 11/2013 | Boyd | |
| 8,795,101 | B2 | 8/2014 | Nishio | |
| 8,814,723 | B2 | 8/2014 | Tavares | |
| 8,870,683 | B2 | 10/2014 | Hettinger | |
| 8,926,450 | B2 | 1/2015 | Takahashi | |
| 8,986,134 | B2 | 3/2015 | Stites | |
| 9,079,368 | B2 | 7/2015 | Tavares | |
| 9,168,435 | B1 | 10/2015 | Boggs | |
| 9,211,448 | B2 | 12/2015 | Bezilla | |
| 9,211,449 | B2 | 12/2015 | Demille | |
| 9,220,955 | B2 | 12/2015 | Hayase | |
| 9,278,264 | B2 | 3/2016 | Stokke | |
| 9,327,172 | B2 | 5/2016 | Deshmukh | |
| 9,352,198 | B2 | 5/2016 | Roach | |
| 9,452,325 | B2 | 9/2016 | DeShiell | |
| 9,457,245 | B2 | 10/2016 | Lee | |
| 9,468,820 | B2 | 10/2016 | Sugimoto | |
| 9,643,065 | B2 | 5/2017 | Stites | |
| 9,802,372 | B2 | 10/2017 | Stites | |
| 9,861,865 | B1 | 1/2018 | Harbert | |
| 9,901,794 | B2 | 2/2018 | Beno | |
| 9,968,833 | B2 | 5/2018 | Breier | |
| 10,046,212 | B2 | 8/2018 | Sargent | |
| 10,065,084 | B2 | 9/2018 | Myrhum | |
| 10,232,230 | B2 | 3/2019 | Takehara | |
| 10,245,479 | B2 | 4/2019 | Murphy | |
| 10,518,141 | B2 | 12/2019 | Goudarzi | |
| 10,596,427 | B2 | 3/2020 | Jertson | |
| 10,828,543 | B2 | 11/2020 | Morales | |
| 10,881,917 | B2 | 1/2021 | Greensmith | |
| 10,953,294 | B2 | 3/2021 | Jertson | |
| 11,071,894 | B2 | 7/2021 | Lee | |
| 11,517,799 | B2 | 12/2022 | Jertson | |
| 11,541,290 | B2 | 1/2023 | Jertson | |
| 11,839,802 | B2 * | 12/2023 | Milleman | A63B 53/06 |
| 2004/0116207 | A1 | 6/2004 | De Shiell | |
| 2005/0159243 | A1 | 7/2005 | Chuang | |
| 2006/0058112 | A1 | 3/2006 | Haralason | |
| 2007/0155533 | A1 | 7/2007 | Solheim | |
| 2008/0139339 | A1 | 6/2008 | Cheng | |
| 2008/0293512 | A1 | 11/2008 | Chen | |
| 2009/0227393 | A1 | 9/2009 | Kenji | |
| 2010/0139079 | A1 | 6/2010 | Dawson | |
| 2017/0072275 | A1 | 3/2017 | Mitzel | |
| 2017/0340932 | A1 * | 11/2017 | Morales | A63B 53/0466 |
| 2019/0282865 | A1 | 9/2019 | Nakamura | |

FOREIGN PATENT DOCUMENTS

| | | |
|---|---|---|
| JP | 3103394 | 8/2004 |
| JP | 2005177092 | 7/2005 |
| JP | 2005230332 | 9/2005 |
| JP | 2011072661 | 4/2011 |
| JP | 2014008141 | 1/2014 |

OTHER PUBLICATIONS

Russley Golf Club; A new level of distance and forgiveness, The new TaylorMade M2 Driver, accessed Sep. 14, 2017.

(56) References Cited

OTHER PUBLICATIONS

New E9 Face Technology With Dual Roll Gives You Even Longer and More Forgiving Drives, Fairway Golf USA, accessed Jun. 7, 2016.
Women's Great Big Bertha Driver, Callaway Certified Pre-Owned, accessed Mar. 18, 2019.
Int'l Search Report and Written Opinion for Int'l Appl. No. PCT/US2020/043483, filed Jul. 24, 2020.
Int'l Search Report and Written Opinion for corresponding Int'l Appl. No. PCT/US2020/062434, filed Nov. 25, 2020.

* cited by examiner

MULTI-COMPONENT GOLF CLUB HEAD

CROSS REFERENCE TO RELATED APPLICATIONS

This is a continuation of U.S. patent application Ser. No. 17/175,558, filed on Feb. 12, 2021, now U.S. Pat. No. 11,839,802, issued on Dec. 12, 2023, which claims the benefit of U.S. Provisional Application No. 62/975,631, filed on Feb. 12, 2020, and is a continuation-in-part of U.S. patent application Ser. No. 17/105,459, filed on Nov. 25, 2020, now U.S. Pat. No. 11,517,799, issued on Dec. 6, 2022, which is a continuation-in-part of U.S. patent application Ser. No. 16/789,261, filed on Feb. 12, 2020, now U.S. Pat. No. 10,953,294, issued on Mar. 23, 2021, which is a continuation of U.S. patent application Ser. No. 16/215,474, filed on Dec. 10, 2018, now U.S. Pat. No. 10,596,427, issued on Mar. 24, 2020, which claims the benefit of U.S. Provisional Patent Application No. 62/596,677, filed on Dec. 8, 2017. U.S. patent application Ser. No. 17/105,459 is also a continuation-in-part of International Patent Application No. PCT/US2020/043483, filed on Jul. 24, 2020, which claims the benefit of U.S. Provisional Patent Application No. 62/878,263, filed Jul. 24, 2019. U.S. patent application Ser. No. 17/105,459 is a continuation-in-part of International Patent Application No. PCT/US2020/047702, filed Aug. 24, 2020, which claims the benefit of U.S. Provisional Patent Application No. 62/891,158, filed on Aug. 23, 2019. U.S. patent application Ser. No. 17/105,459 further claims the benefit of U.S. Provisional Patent Application No. 62/940,799, filed Nov. 26, 2019, U.S. Provisional Patent Application No. 62/976,229, filed Feb. 13, 2020, and U.S. Provisional Patent Application No. 63/015,398, filed Apr. 24, 2020. The contents of all the above-described disclosures are incorporated fully herein by reference in their entirety.

FIELD

This invention generally relates to golf equipment, and more particularly, to multi-component golf club heads and methods to manufacture multi-component golf club heads.

BACKGROUND

In general, the club head mass is the total amount of structural mass and the amount of discretionary mass. In an ideal club design, having a constant total swing weight, structural mass would be minimized (without sacrificing resiliency) to provide a designer with sufficient discretionary mass for optional placement to customize and maximize club performance. Structural mass generally refers to the mass of the materials required to provide the club head with the structural resilience to withstand repeated impacts. Structural mass is highly design-dependent, and provides a designer with a relatively low amount of control over specific mass distribution. Conversely, discretionary mass is any additional mass (beyond the minimum structural requirements) that may be added to the club head design solely to customize the performance and/or forgiveness of the club. There is a need in the art for alternative designs to all metal golf club heads to provide a means for maximizing discretionary weight to maximize club head moment of inertia (MOI) and lower/back center of gravity (CG), and provide options for golf ball flight manipulation.

Figure 1:
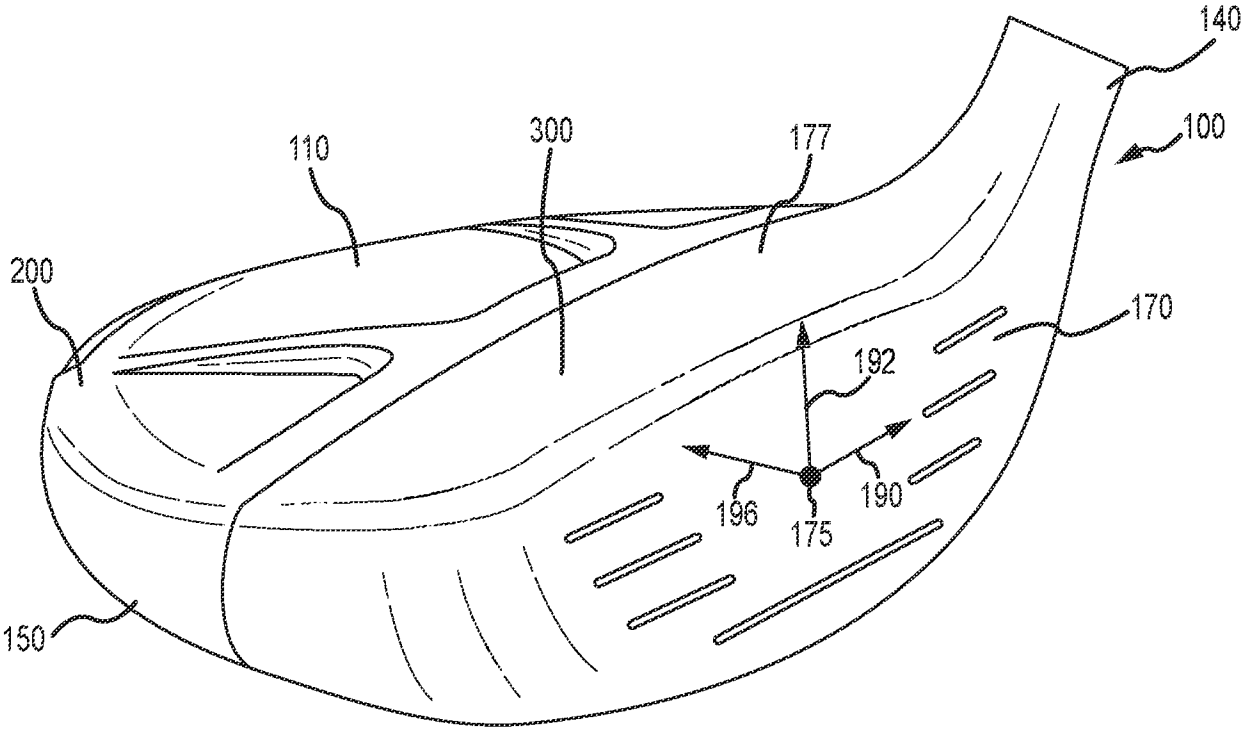
FIG. 1 illustrates a front perspective view of a wood-type club head comprising a first component and a second component according to a first embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The present embodiments are directed to wood-type club heads (e.g. fairway wood or hybrid) with multi-material constructions that increase or maximize the club head moment of inertia with a low and back center of gravity position. In addition, the design provides greater launch angle and/or loft to lift the golf ball higher off the ground and prevent overspinning. The wood type club head comprises a two-component design. The wood type club head comprises a first component comprising a metallic material, and the second component comprises a non-metallic material. The first component comprises the load bearing structure and the majority of the club head mass. The second component comprises a lightweight structure that wraps around the first component to form portions of a crown, a heel, a toe, and a sole of the club head. The first component comprises a rearwardly extending sole portion or sole rear extension that extends away from a striking face. The first component having the sole extension receives removable weights for weight adjustment, and can include ribs for structural reinforcement or sound control. The first component can resemble a "T" shape when viewed from above.

This two-component design provides additional discretionary mass to be redistributed into, for example, a removable weight, to improve center of gravity (CG) location and moment of inertia (MOI). The two-component design allows for precise adjustments of CG location and MOI compared to all metal club heads that have limitations in mass movement (e.g. difficult to remove mass from the crown). Further, golf ball overspin can be prevented by adding mass centrally or in a forward portion of the club head (e.g. mass pads positioned in a central portion of the sole or in a forward portion of the sole). The mass pads can comprise a mass ranging from 25 grams to 45 grams. Further still, additional mass pads can be positioned in the extreme rear of the club head to further move the center of gravity lower and rearward. The club head comprising the metallic first component, the non-metallic second component, and the mass pad reduces golf ball spin by about 100 to 200 rpm compared to a golf club head devoid of the metallic first component, the non-metallic second component, and the mass pad.

The combination of a wrap-around composite design, removable weights, and mass pads provides a high lofted fairway wood (15 degrees to 18 degrees) with a low center of gravity that is forgiving and a reduces golf ball spin by about 100 to 200 rpm over a club head devoid of the metallic first component, the non-metallic second component, and the mass pad. Further, the fairway wood described in this disclosure does not comprise a sole channel to control golf ball spin. The fairway wood described in this disclosure utilizes the wrap-around composite design, removable weights, and mass pads to control golf ball spin.

The two-component club head design reduces the mass in the crown and allows the mass to be distributed to the first component or a removable weight. The movement of mass shifts the center of gravity closer to the sole and the rear of the club head. The multi-component club head design formed from multiple materials aims to have a low and back center of gravity to 1) reduce golf ball backspin, (2) maintain or improve momentum transfer between the club head and the golf ball, (3) increase golf ball speed and distance, and (4) allow increase in loft/launch angle without deleterious addition of spin.

The club head may be a hollow, wood-style golf club head that is formed by securing a first component with a second component to form a closed internal volume therebetween. The first component can include both the striking face and a portion of the sole, and can be formed from a metal or metal alloy. The second component can form at least a portion of the crown and can wrap around to further form both a heel portion and a toe portion of the sole. In this design, the metallic first component extends between the polymeric heel portion of the sole and the polymeric toe portion of the sole.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "first," "second," "third," "fourth," "fifth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein. In the interest of consistency and clarity, all directional references used herein assume that the referenced golf club head is resting on a horizontally flat ground plane such that predefined loft and lie angles for the club head are achieved. The "front" or "forward portion" of the golf club head generally refers to the side of the golf club head (when viewed normal to the ground plane) that includes the golf club head strikeface. Conversely, the rear portion of the club head is opposite the strikeface and can include anything behind the strikeface and/or portions of the club head that are trailing the strike face at impact.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The terms "loft" or "loft angle" of a golf club, as described herein, refers to the angle formed between the club face and the shaft, as measured by any suitable loft and lie machine.

In many embodiments, the loft angle for fairway wood-type club heads can be less than approximately 35 degrees, less than approximately 34 degrees, less than approximately 33 degrees, less than approximately 32 degrees, less than approximately 31 degrees, or less than approximately 30 degrees. Further, in some embodiments, the loft angle of fairway wood-type club heads can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of fairway wood-type club heads can be between 12 degrees and 35 degrees, between 15 degrees and 35 degrees, between 20 degrees and 35 degrees, or between 12 degrees and 30 degrees.

Further, the volume for fairway wood-type club heads can be less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of fairway wood-type club heads can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

In many embodiments, the loft angle for hybrid-type club heads can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of hybrid-type club heads can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, the volume for hybrid-type club heads can be less than approximately 200 cc, less than approximately 175 cc, less than approximately 150 cc, less than approximately 125 cc, less than approximately 100 cc, or less than approximately 75 cc. In some embodiments, the volume of hybrid-type club heads can be approximately 100 cc-150 cc, approximately 75 cc-150 cc, approximately 100 cc-125 cc, or approximately 75 cc-125 cc.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Wood-Type Club Head

Figure 2:
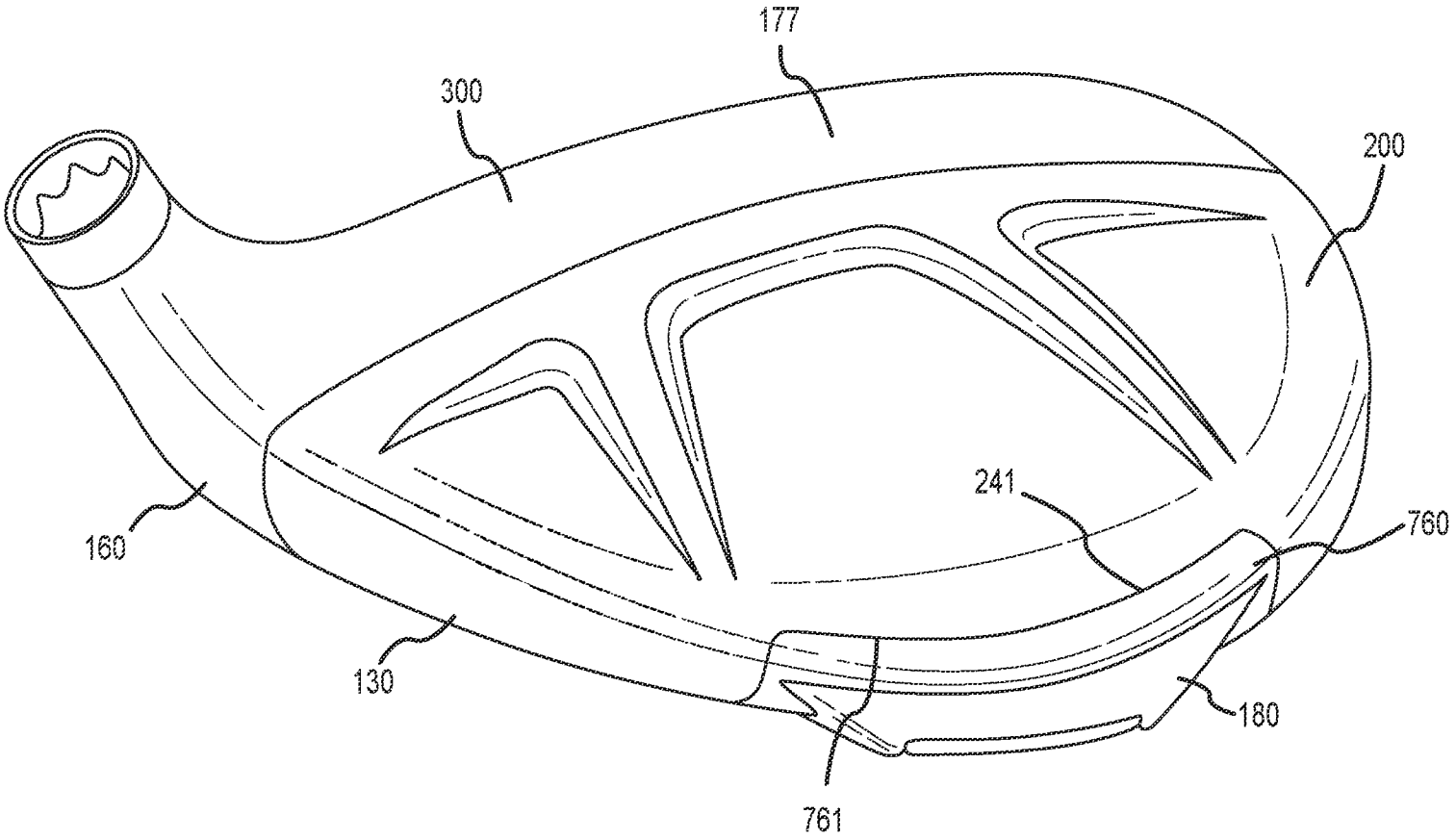
FIG. 2 illustrates a rear perspective view of the club head of FIG. 1.

Referring to the drawings, wherein like reference numerals are used to identify like or identical components in various views, FIGS. 1-10 schematically illustrate a first embodiment of a wood-type club head. Specifically, FIG. 1 illustrates a front perspective view of a fairway wood-type club head 100. FIG. 2 illustrates a rear perspective view of the fairway wood-type club head 100. The club head comprises a first component 300 and a second component 200 that are secured together to define a substantially closed/hollow interior volume. The club head 100 comprises a striking face 170, a rear end 180 opposite the striking face 170, a return portion 177, a crown 110, a sole 120 opposite the crown 110, a heel end 160, a toe end 150 opposite the heel end 160, and a skirt 130 (i.e. portion of the club head 100 between the crown 110 and the sole 120). The skirt 130 can be formed from a combination of the first component 300 and the second component 200. The club head 100 can further comprise a hosel 140 having a hosel adaptor attachment recess 195 for receiving a hosel adaptor (illustrated in FIG. 10) and a golf club head shaft (not shown).

The striking face 170 of the club head 100 is intended to impact a golf ball. The club head 100 further defines a striking face center or geometric center 175, and a striking face perimeter. In some embodiments, the geometric center 175 can be located at the geometric center point of a striking surface. In another approach, the geometric center 175 of the striking surface can be located in accordance with the definition of a golf governing body such as the United States Golf Association (USGA). The club head 100 further defines a loft plane 198 tangent to the geometric center 175 of the striking face 170. The striking face perimeter can be located along an outer edge of the striking face 170 can define a boundary where the curvature of the striking face 170 deviates from the bulge and roll curvature. Further, a face height can be measured parallel to the loft plane 198 between a top end of the striking face perimeter near the crown 110 and a bottom end of the striking face perimeter near the sole 120.

Figure 3:
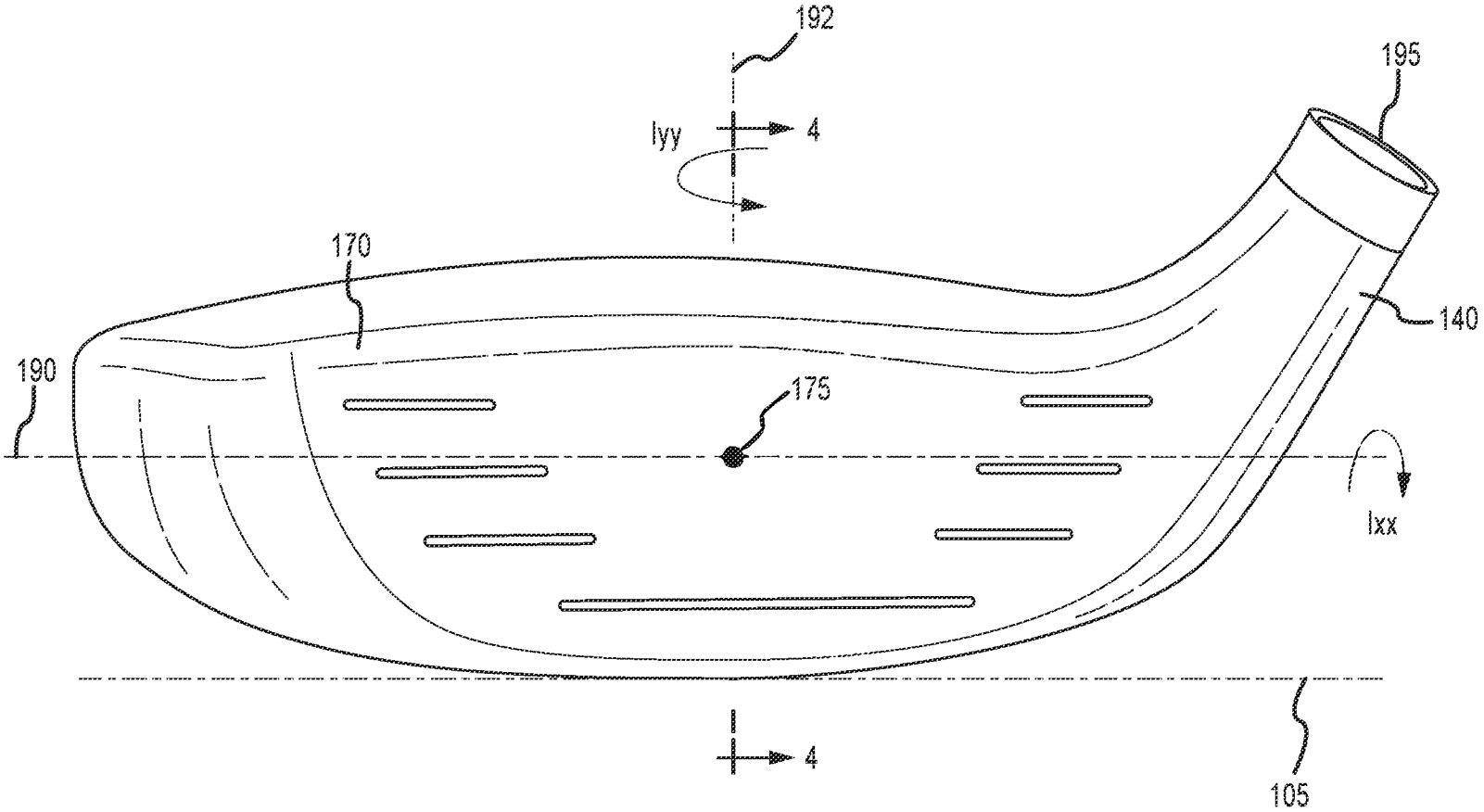
FIG. 3 illustrates a front view of the club head of FIG. 1.
Figure 4:
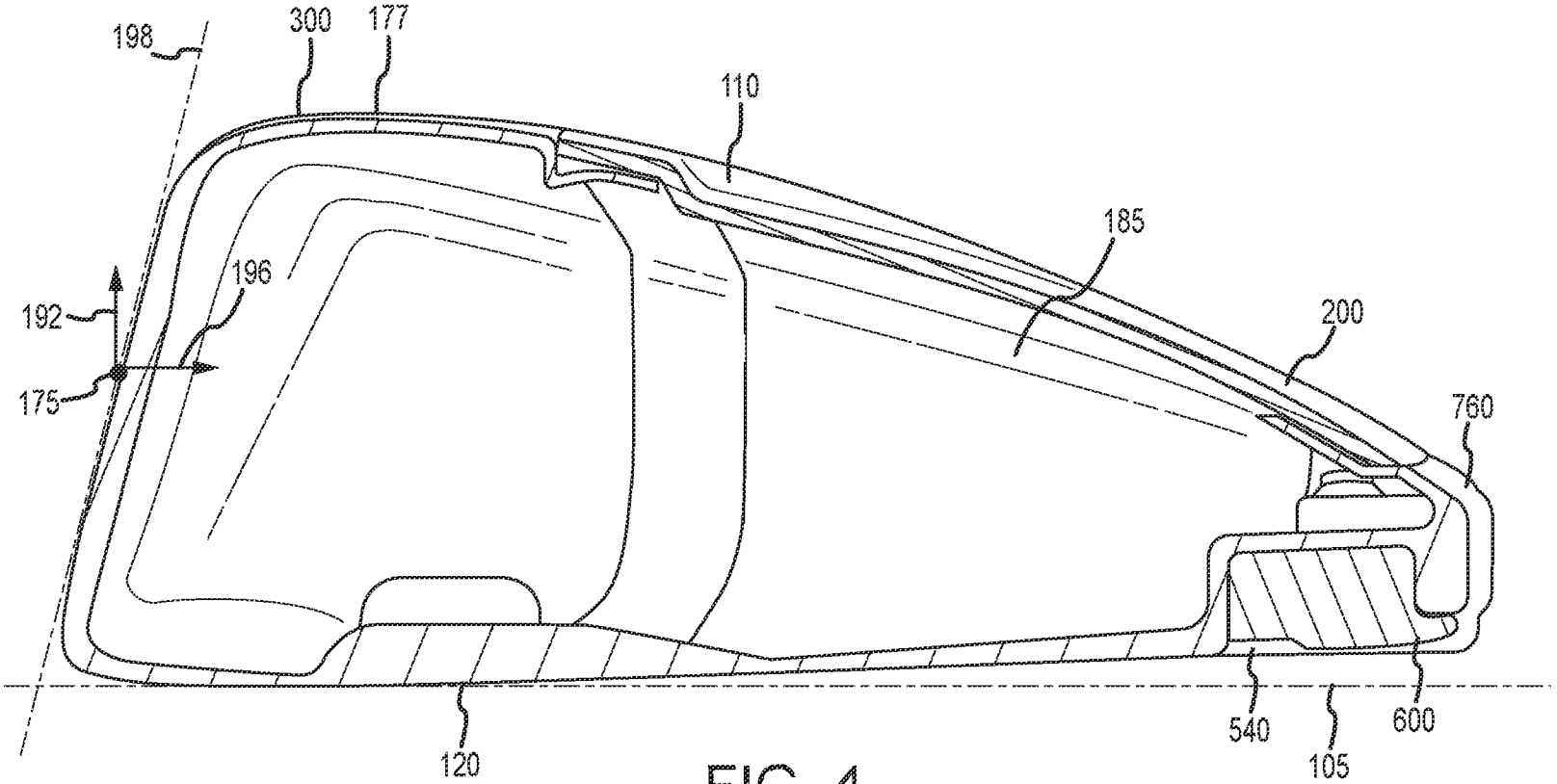
FIG. 4 illustrates a cross sectional view of the club head of FIG. 1 taken at line 4-4 of FIG. 3.

Referring to FIGS. 1, 3, and 4, the geometric center 175 of the striking surface defines an origin for a coordinate system having an x-axis 190, a y-axis 192, and a z-axis 196. The club head 100 further defines a ground plane 105 that is tangent to the sole 120 when the club head 100 is at an address position. The x-axis 190 is a horizontal axis that extends through the geometric center 175 in a direction from near the heel end 160 to near the toe end 150 parallel to the ground plane 105. The y-axis 192 is a vertical axis that extends through the geometric center 175 in a direction from near the sole 120 to near the crown 110, where the y-axis 192 is perpendicular to the x-axis 190 and to the ground plane 105. The z-axis 196 extends through the geometric center 175 rearward the striking face 170 in a direction parallel with the ground plane 105. The z-axis 196 is perpendicular to the x-axis 190 and the y-axis 192.

The coordinate system defines an XY plane extending through the x-axis 190 and the y-axis 192, an XZ plane extending through the x-axis 190 and the z-axis 196, and a YZ plane 193 extending through the y-axis 192 and the z-axis 196. The XY plane, the XZ plane, and the YZ plane are all perpendicular to one another and intersect at the geometric center 175 of the striking surface. The loft plane 198 is positioned at an angle from the XY plane.

The sole 120 can be defined as a portion of the club head 100 that is tangent to the ground plane 105 at the address position. A skirt 130 of the club head 100 can be defined as a junction between the sole 120 and the crown 110, forming a perimeter of the club head 100 behind the striking face 170. Stated another way, the skirt 130 can be a portion of the club head 100 that transitions from the crown 110 to the sole 120.

The club head 100 can have a hollow body construction that forms a closed internal cavity 185. The first component 300 and the second component 200 cooperate, secure, and/or couple together to define the closed internal cavity 185. The first component 300 and the second component 200 of the club head 100 define the outer boundary of the internal cavity 185.

Figure 5:
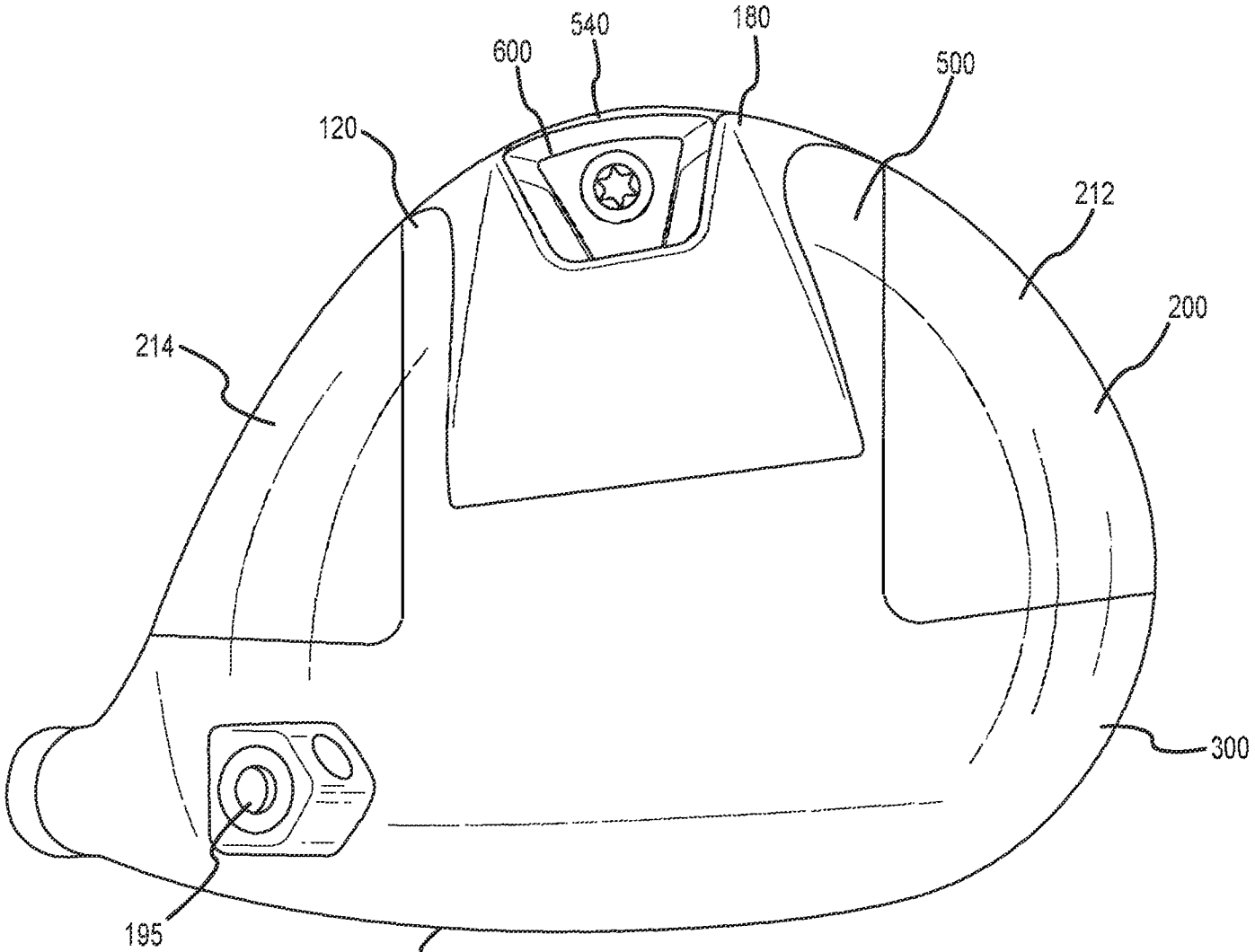
FIG. 5 illustrates a sole view of the club head of FIG. 1.

Referring to FIG. 5, the first component 300 generally resembles a T-shape. The first component 300 can comprise a sole rear extension 500 with a recess 540 for receiving at least one removeable weight 600. The sole rear extension 500 of the first component 300 can form a portion of the sole 120. The second component 200 forms the remainder of the sole 120. This configuration lowers the center of gravity toward the sole 120 and towards the rear end 180 of the assembled club head 100.

The first component 300 comprises a first material having a first density. The first material can be a metallic material. The first component 300 comprises a first component mass. In some embodiments, the first component 300 can be integrally formed as a single piece, wherein the first component 300 is formed with a single material. Alternately, the first component 300 can receive a separately formed striking face insert that can be secured to the front portion of the club head 100. The separately formed striking face insert can comprise a metallic material different from the metallic material of the first component 300.

The second component 200 comprises a second material having a second density. The second material can be a non-metallic material. The second component 200 comprises a second component mass. The second component further comprises a skirt portion 230, a crown portion 205, a toe portion 212, and a heel portion 214. The second component skirt portion 230 connects the second component crown portion 205 with the second component sole portions (212, 214) as the second component 200 wraps around the first component 300.

The first density of the first component 300 can be greater than the second density of the second component 200. The mass percentage of the first component 300 can range from 80% to 95% of the total mass of golf club head 100. For example, the mass percentage of the first component 300 can be 80%, 85%, 86%, 87%, 88%, 89%, 90%, 91%, 92%, 93%, 94%, or 95% of the total mass of the club head 100. The mass percentage of the second component 200 can range from 3% to 15% of the total mass of golf club head 100. For example, the mass percentage of the second component 200 can be 3%, 4%, 5%, 6%, 7%, 8%, 9%, 10%, 11%, 12%, 13%, 14%, or 15% of the total mass of the golf club head 100.

The sole rear extension 500 of the first component 300 can comprise a location for removable weights, mating structures, and/or support structures such as ribs to further adjust the total mass of the club head 100. Further, the removeable weight allows for a greater amount of mass to be positioned at an extreme rear position of the club head 100 to provide mass characteristics that are functionally desirable. For example, positioning the mass at the extreme rear position on the sole rear extension 500 of the first component 300 can move the center of gravity low and back to achieve desirable golf ball characteristics such as speed, distance, and spin. The multi-component construction and center of gravity position is desirable in reducing golf ball spin. The first component 300, the second component 200, and the advantages of a multi-component club head design are described in more detail below.

First Component

As described above, the club head 100 comprises the first component 300 formed from a metallic material. The first component 300 comprises the load bearing structure and the majority of the club head mass. The first component 300 receives removable weights to further adjust center of gravity location and moment of inertia. The removeable weights can be used to move a greater amount of mass rearward to provide a low and rear center of gravity position. The first component 300 can further comprise mass pads for moving mass forward toward the striking face 170 to offset the mass placed rearward on the club head 100. Placing mass pads centrally on the sole 120 or in a forward portion of the sole 120 can move mass forward to control spin. The structure of the first component 300 of the club head 100 balances the mass placement to achieve a low and rear center of gravity position, increased moment of inertia, and golf spin control. Further, the first component 300 can include ribs to provide structural reinforcement or sound control (not shown).

As illustrated in FIGS. 5-8, the first component 300 comprises the striking face 170, the return portion 177, and the sole rear extension 500. The return portion 177 connects to the striking face 170 and extends rearward from the striking face 170. The return portion 177 forms at least a portion of the crown 110, a portion of the sole 120, the hosel 140, a portion of the heel end 160, and a portion of the toe end 150. The sole rear extension 500 connects to and extends rearward from the return portion 177. The sole rear extension 500 forms at least a portion of the sole 120. The sole rear extension 500 extends from the return portion 177 towards the skirt 130 of the club head 100.

Figure 6:
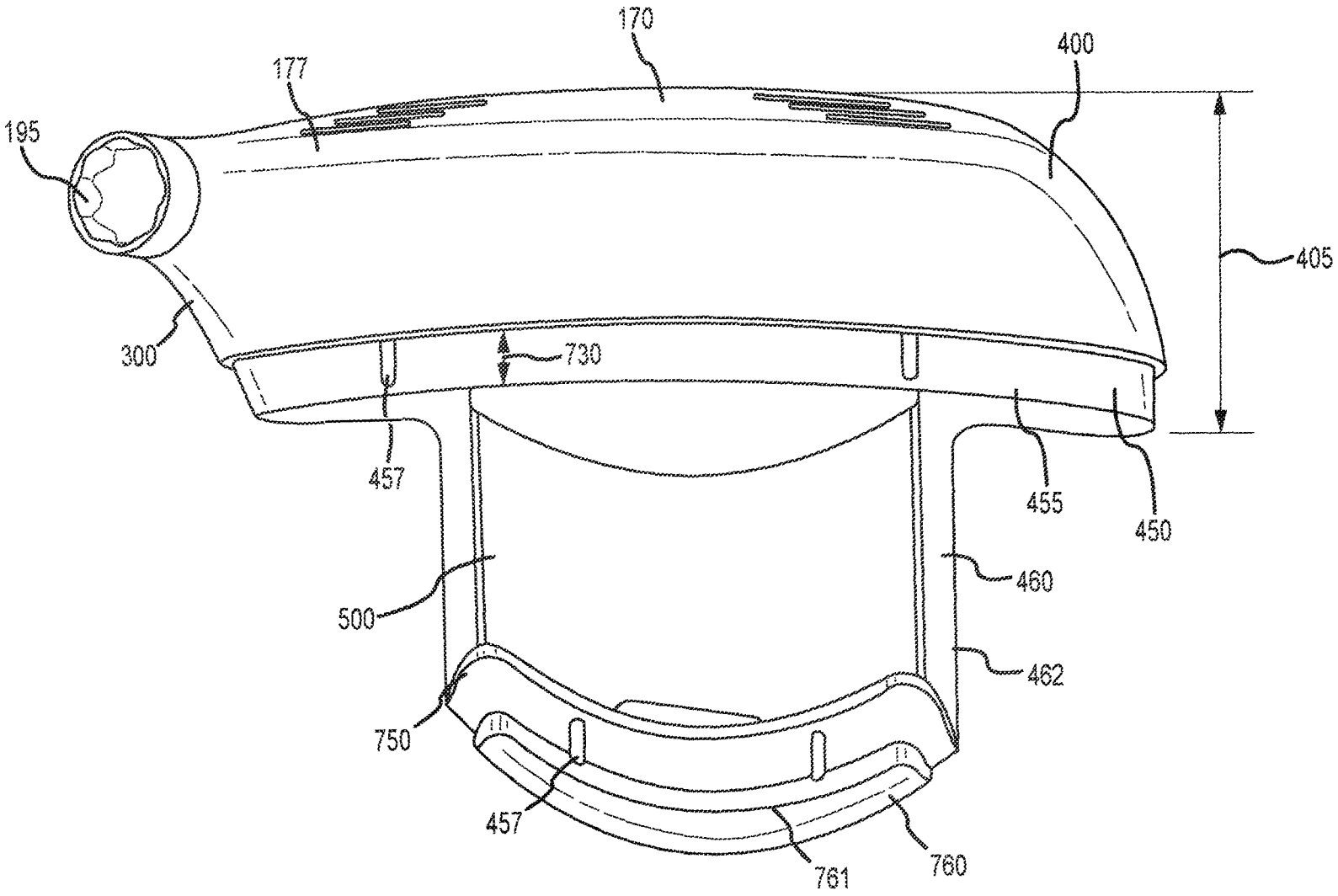
FIG. 6 illustrates a top view of the first component of the club head of FIG. 1.
Figure 7:
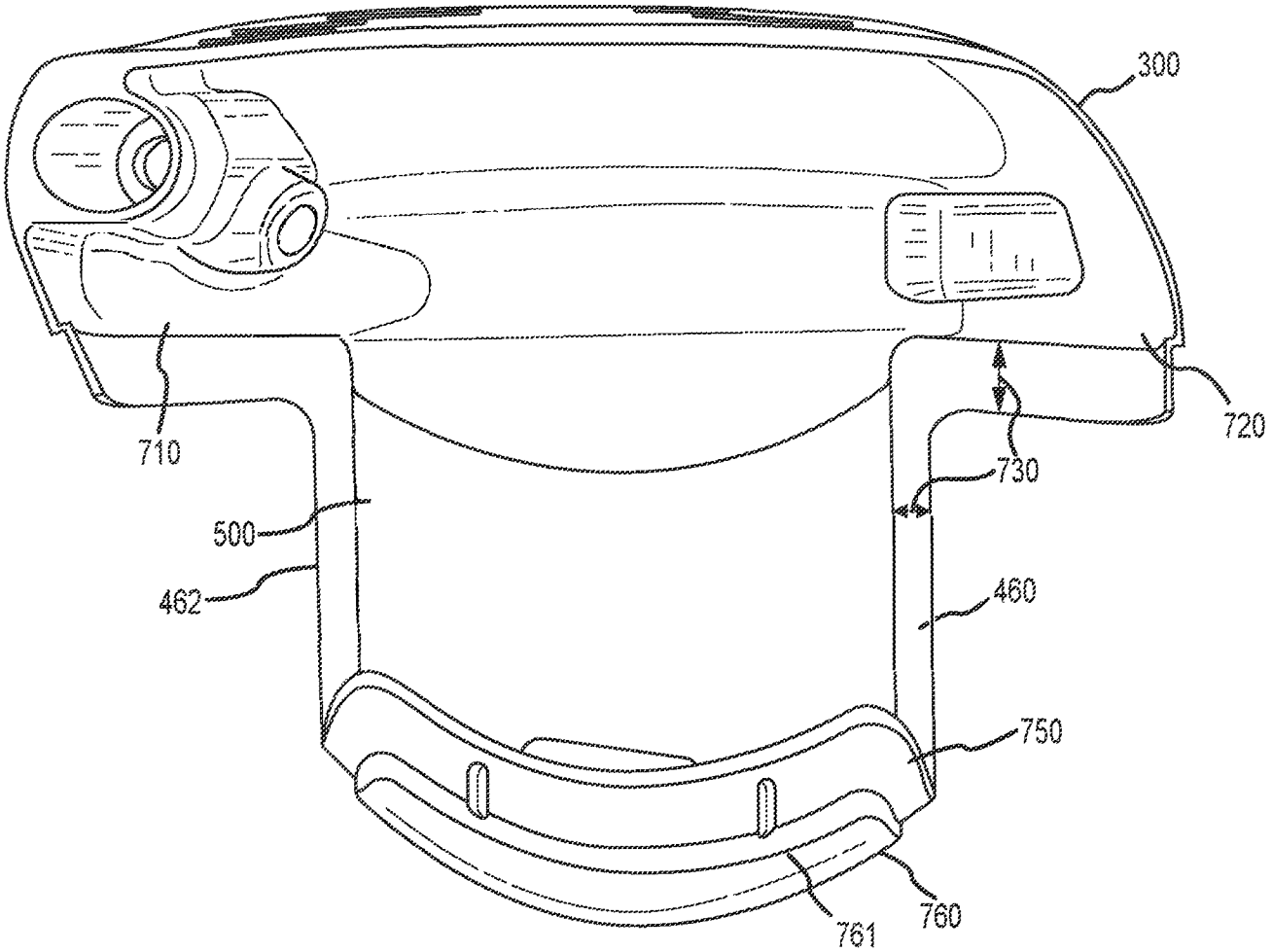
FIG. 7 illustrates a cross sectional view of the first component of the club head of FIG. 1.

As illustrated in FIGS. 2, 6, and 7, the sole rear extension 500 can further comprise a shelf 760. The shelf 760 of the sole rear extension 500 can extend vertically from the sole rear extension 500. The shelf 760 supports the second component 200 at the rear end 180 of the club head 100. The shelf 760 provides a mating surface for a portion of the second component 200 at the rear end 180 when the first component 300 and the second component 200 are secured together to form the assembled club head 100. The shelf 760 of the first component 300 can form a portion of the skirt 130 and/or the crown 110 of the club head 100. The shelf 760 can define a rearward profile in a heel end to toe end direction relative to the striking face 170 (viewed from a top view perspective of the club head 100). The shelf 760 can further define a shelf forward edge 761 extending along the rearward profile, wherein the shelf forward edge 761 is configured to abut the second component 200 (described in further detail below). The rearward profile of the shelf 760 can extend from the heel end 160 toward the toe end 150 in a straight-lined profile, in a positive parabolic profile, in a bell-shaped profile, a curvilinear profile, a concave profile, a convex profile, or any other suitable profile relative to the striking face 170. In one embodiment as illustrated in FIG. 7, the rearward profile of the shelf 760 can be convex relative to the striking face 170. In other embodiments, the shelf 760 may form only a portion of the skirt 130, wherein the first component 300 abuts the second component 200 within the skirt 130 of the club head 100 at the rear end 180.

The first component 300 comprises a bond surface in the formed of a recessed lip 450. The first component lip 450 extends along a first component perimeter edge 462, wherein the first component perimeter edge 462 extends along a perimeter of the return portion 177 (i.e. the crown return portion 400 and the sole return portion 810), the sole rear extension 500, and the shelf 760. The recessed lip 450 can be recessed from an outer surface of the club head 100 to accommodate the combined thickness of the overlap between the first component 300 and the second component 200, and any adhesives used to secure the two components together.

The first component lip 450 can comprise a crown return portion lip 455, a sole lip 460, a vertical lip 750, and a plurality of bonding features 457. The crown return portion lip 455 can be recessed from an outer surface of the crown return portion 400, the sole lip 460 can be recessed from an outer surface of the sole 120 (i.e. an outer surface of the sole return portion 810 and an outer surface of the sole rear extension 500), and the vertical lip can be recessed from an outer surface of the shelf 760. The bonding features 457 can promote a uniform adhesive layer between the first component 300 and the second component 200. The bonding features 457 can include one or more bumps, ridges, or tabs that are spaced along the recessed lip 450. The bonding features 457 can be equally spaced from each other or localized in an area on the bond surface.

In one example, the bonding features 457 can comprise tabs that correspond with matching grooves on the second component 200 (not shown). The tabs 457 of the first component 300 and the corresponding grooves of the second component 200 align the first component 300 with the second component 200 and prevent any sideways movement between the first and second components (300, 200). In another example, the second component 200 may not comprise corresponding grooves to receive the first component tabs 457. In embodiments where the bonding features 457 comprise tabs, the first component tabs 457 provide predetermined spacing (i.e. an adhesive gap) between the first and second components (300, 200). This predetermined spacing can allow the adhesive to bond uniformly and evenly across the lap joint.

The bonding features 257 can protrude above the bond surface by about 0.001 to 0.01 inch. In some embodiments, the bonding features 257 can protrude above the bond surface by about 0.001 to 0.005 inch, or 0.005 to 0.01 inch. For example, the bond features can protrude above the bond surface by about 0.001, 0.005, 0.006, 0.007, 0.008, 0.009, or 0.01 inch.

Referring to FIGS. 6 and 7, the first component lip 450 comprises a width 730. The width of the first component lip 450 can be measured as a transverse width from where the first component 300 is recessed with respect to the outer surface to the perimeter edge 462. The crown return portion lip 455, the sole lip 460, and the vertical lip 750 can comprise similar or equal widths. In other embodiments, the crown return portion lip 455, the sole lip 460, and the vertical lip 750 can comprise different widths. In some embodiments, the width of the crown return portion lip 455 and/or the vertical lip 750 can comprise a greater width than the sole lip 460. In many embodiments, the first component lip width 730 can range from 0.1 inch to 0.3 inch. In some embodiments, the first component lip width 730 can range from 0.1 to 0.2 inch, or 0.2 to 0.3 inch. For example, the first component lip width 730 can be 0.100 inch, 0.125 inch, 0.130 inch, 0.150 inch, 0.175 inch, 0.200 inch, 0.220 inch, 0.225 inch, 0.230 inch, 0.250 inch, 0.275 inch, or 0.300 inch. In one example, the first component lip width 730 can range from 0.125 inch to 0.275 inch.

The first component lip 450 can comprise a thickness measured between the outer surface and the inner surface of the first component lip 450. In many embodiments, the thickness of the first component lip 450 can range between 0.015 inch and 0.035 inch. In some embodiments, the thickness of the first component lip 450 can range 0.015 inch to 0.025 inch, or 0.025 inch to 0.035 inch. For example, the thickness of the first component lip 450 can be 0.015, 0.020, 0.022, 0.023, 0.024, 0.025, 0.026, 0.027, 0.028, 0.029, 0.030, or 0.035 inch. In one example, the thickness of the first component lip 450 can range from 0.015 inch to 0.030 inch. In another example, the thickness of the first component lip 450 can be 0.025 inch.

Referring to FIG. 6, the return portion 177 comprises a crown portion 400 having a crown return portion length 405. The crown return portion 400 comprises a rearward perimeter that forms a profile on the crown 110 from the heel end 160 to the toe end 150. The crown return portion length 405 may vary across the width of the club head 100 in a direction from the heel end 160 to the toe end 150. The crown return portion length 405 may be comprise a maximum length near the geometric center 175, the heel end 160, or the toe end 150. In some embodiments, the crown return portion length 405 can be similar or equal to the sole return portion length 815. In other embodiments, the crown return portion length 405 can be different than the sole return portion length 815. In many embodiments, the crown return portion length 405 can range 1.0 inch to 2.5 inches. In some embodiments, the crown return portion length 405 can range from 1.0 inch to 1.75 inches, or 1.75 inches to 2.5 inches. For example, the crown return portion length 405 can be 1.0, 1.1, 1.2, 1.3, 1.4, 1.5, 1.6, 1.7, 1.8, 1.9, 2.0, 2.1, 2.2, 2.3, 2.4, or 2.5 inches. In one example, the crown return portion length 405 can range from 1.0 inch to 1.75 inches.

Figure 8:
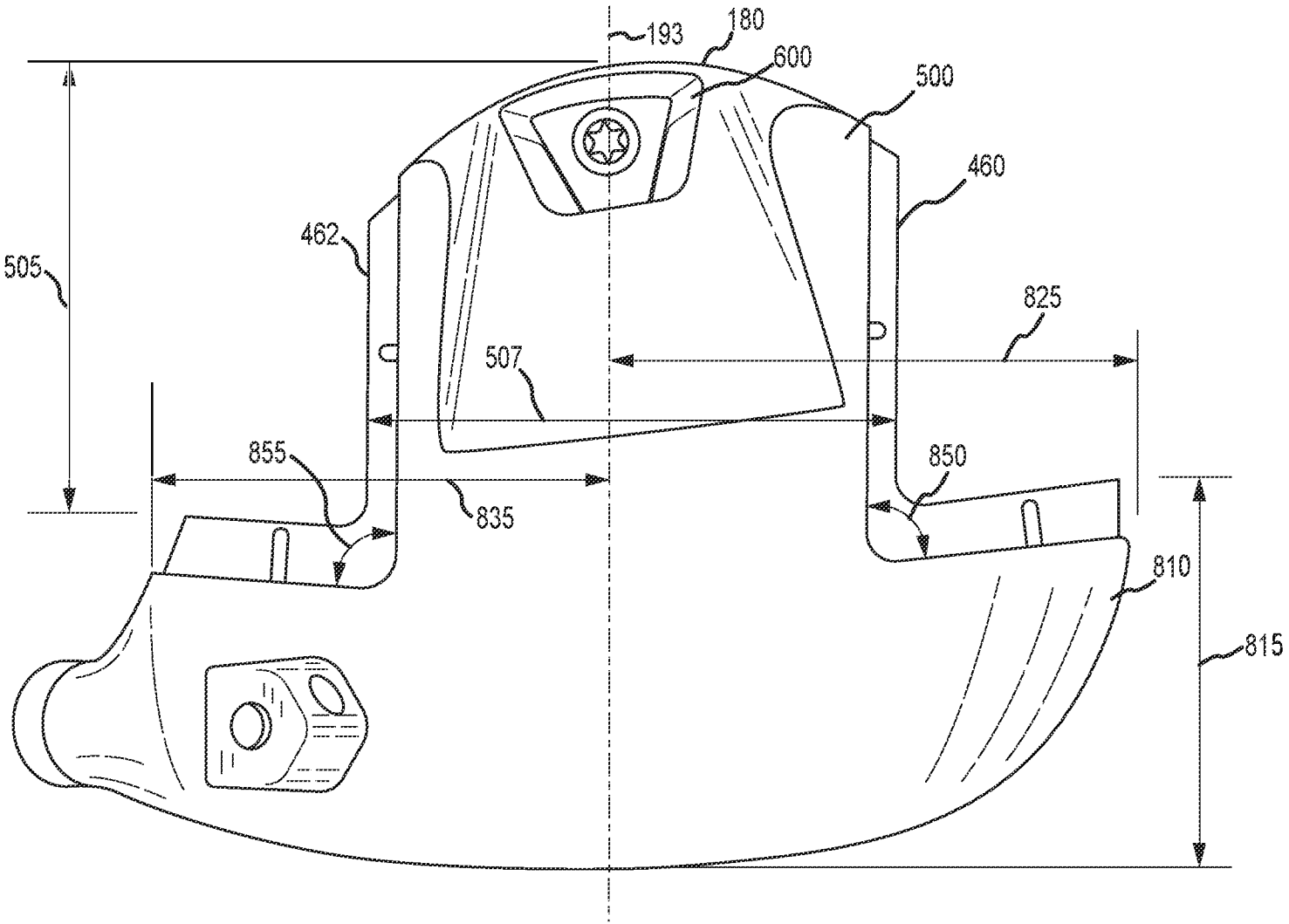
FIG. 8 illustrates a sole view of the first component of the club head of FIG. 1.

Referring to FIGS. 7 and 8, the return portion 177 comprises a sole portion 810 having a sole return portion length 815. The sole return portion length 815 is measured in a direction from the striking face 170 to the rear end 180. Specifically, the sole return portion length 815 is measured from the loft plane 198 to a rear perimeter of the return portion 177. In many embodiments, the sole return portion length 815 can range from 1.0 inch to 2.5 inches. In some embodiments, the sole return portion length 815 can range from 1.0 to 1.75 inches, or 1.75 to 2.5 inches. For example, the sole return portion length 815 can be 1.0, 1.1, 1.2, 1.3, 1.4, 1.5, 1.6, 1.7, 1.8, 1.9, 2.0, 2.1, 2.2, 2.3, 2.4, or 2.5 inches. In one example, the sole return portion length 815 can range from 1.0 inch to 1.75 inch.

The return portion 177 of the first component 300 can comprise a thickness measured between the outer surface and the inner surface of the return portion 177. The thickness of the crown return portion 400 and the sole return portion 810 can be similar or equal. In other embodiments, the thickness of the crown return portion 400 and the sole return portion 810 can be different. In many embodiments, the thickness of the return portion 177 can range from 0.015 inch to 0.040 inch. In some embodiments, the thickness of the return portion 177 can range from 0.015 inch to 0.025 inch, or 0.025 inch to 0.040 inch. In other embodiments, the thickness of the return portion 177 can range from 0.02 inch to 0.03 inch, or 0.03 inch to 0.04 inch. For example, the thickness of the return portion 177 can be 0.015, 0.02, 0.025, 0.028, 0.029, 0.03, 0.031, 0.032, 0.033, 0.034, 0.035, or 0.04 inch. In one example, the thickness of the return portion 177 can range from 0.025 to 0.04 inch. In some embodiments, the thickness of the first component 300 can vary at the striking face 170, the return crown portion 400, the return sole portion 810, the heel extension 710, the toe extension 720, or the sole rear extension 500. The striking face 170 can comprise a variable thickness (e.g. maximum thickness at a central region of the striking face 170, and a minimum thickness at a perimeter region of the striking face 170) to improve characteristic time (CT) or ball speed performance.

Referring to FIG. 8, the sole rear extension 500 comprises a sole rear extension length 505 and a sole rear extension width 507. The rear extension length 505 is measured in a direction from the striking face 170 to the rear end 180.

Specifically, the sole rear extension length 505 is measured from the rear perimeter of return portion 177 to a rearmost point of the rear end 180. The sole rear extension length 505 and the sole return portion length 815 together comprise a total sole length of the club head 100. In many embodiments, the sole rear extension length 505 can range between 1.5 inches to 3.5 inches. In some embodiments, the sole rear extension length 505 can range between 1.5 inches to 2.5 inches, or 2.5 to 3.5 inches. For example, the sole rear extension length 505 can be 1.5. 1.6, 1.7, 1.8, 1.9, 2.0, 2.1, 2.2, 2.3, 2.4, 2.5, 3.0, or 3.5 inches. In one example, the sole rear extension length 505 can range from 1.5 to 2.5 inches.

The sole rear extension width 507 is measured in a heel end to toe end direction. The sole rear extension width 507 is less than a width of the sole 120 of the club head 100. In many embodiments, the sole rear extension width 507 can range from 1.5 inch to 3.5 inches. In some embodiments, the sole rear extension width 507 can range from 1.5 to 2.5 inches, or 2.5 to 3.5 inches. For example, the sole rear extension width 507 can be 1.5, 2.0, 2.1, 2.2, 2.3, 2.4, 2.5, 2.6, 2.7, 2.8, 2.9, 3.0, or 3.5 inches. In one example, the sole rear extension width 507 can range from 2.0 inches to 3.0 inches. Stated another way, the sole rear extension width 507 can range from 45% to 85% of the width of the sole 120. The width of the sole 120 can be measured between a most heelward point on the club head 100 to a most toeward point of the club head 100. In other embodiments, the sole rear extension width 507 can range from 45% to 65%, or 65% to 85% of the width of the sole 120. For example, the sole rear extension width 507 can be 45%, 50%, 55%, 60%, 65%, 70%, 75%, 80%, or 85% of the width of the sole 120.

Referring to FIGS. 7 and 8, the first component 300 comprises a heel extension 710 having a heel extension width 835, and a toe extension 720 having a toe extension width 825. The heel extension 710 can be a portion of the return 177 that extends in a direction toward the heel end 160, and the toe extension 720 can be a portion of the return 177 that extends in a direction toward the toe end 150. The toe extension width 825 can be measured from the YZ plane 193 or z-axis 196 to a toe most point of the club head 100 in a direction extending parallel with the x-axis 190. The heel extension width 835 can be measured from the YZ plane 193 or z-axis 196 to a toe most point of the club head 100 in a direction extending parallel with the x-axis 190. In some embodiments, the toe extension width 825 and the heel extension width 835 can be equal. In other embodiments, the toe extension width 825 and the heel extension width 835 can be different. In other embodiments, the toe extension width 825 can be greater than the heel extension width 835. In other embodiments still, the toe extension width 825 can be less than the heel extension width 835.

In many embodiments, the toe extension width 825 or the heel extension width 835 can range from 1.5 inches to 2.75 inches. In some embodiments, the toe extension width 825 or the heel extension width 835 can range from 1.75 inches to 2.5 inches, or 2.0 inches to 2.75 inches. For example, the toe extension width 825 or the heel extension width 835 can be 1.5, 1.75, 2.0, 2.1, 2.2, 2.3, 2.4, 2.5, or 2.75 inches. In one example, the toe extension width 825 or the heel extension width 835 can range from 1.75 inch to 2.5 inches.

Referring to FIG. 8, another means of manipulating the mass properties of the club head 100 is to change how the sole rear extension 500 extends from the return portion 177 of the first component 300. In one example, the sole rear extension 500 can extend from the return portion 177 at an angle relative to the toe extension 720 or the heel extension 710. A heel-ward angle 855 is formed between the sole rear extension 500 and the heel extension 710, and a toe-ward angle 850 is formed between the sole rear extension 500 and the toe extension 720. The toe-ward angle 850 and the heel-ward angle 855 can be supplementary angles (i.e. two angles that add up to 180 degrees). In one embodiment, the toe-ward angle 850 and the heel-ward angle 855 can be 90 degrees, where the sole extension 500 can be substantially perpendicular to the striking surface. In alternative embodiments, the toe-ward angle 850 and the heel-ward angle 855 can vary between 45 degrees and 135 degrees. For example, the toe-ward angle 850 can be 100 degrees, while the heel-ward angle 855 is the supplementary 80 degrees. In this embodiment, when the toe-ward angle 850 is obtuse, the sole rear extension 500 is angularly offset toward the heel end 160 of the club head 100. In another example, the heel-ward angle 855 can be 100 degrees, while the toe-ward angle 850 is the supplementary 80 degrees. In this embodiment, when the heel-ward angle 855 is obtuse, the sole rear extension 500 is angularly offset toward the toe end 150 of the club head 100. Other combinations of toe-ward angles 850 and heel-ward angles 855 can be 110 degrees and 70 degrees, 120 degrees and 60 degrees, 130 degrees and 50 degrees, or 135 degrees and 45 degrees. For example, the toe-ward angle 850 or the heel-ward angle 855 can be 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, or 145 degrees. The angular offset of the sole rear extension 500 can be desirable to place greater mass rearward towards the heel end 160 or toe end 150 of the club head 100 to influence the ball flight characteristics.

In other embodiments, the sole rear extension 500 can extend rearward toward the toe end 150 forming an acute angle in relationship to the YZ plane 193 or z-axis 196, wherein the acute angle is between 10 degrees and 40 degrees. In other embodiments, the sole rear extension 500 can extend rearward toward the heel end 160 forming an acute angle in relationship to the YZ plane 193 or z-axis 196, wherein the acute angle is between 10 degrees and 40 degrees. In other embodiments, the acute angle can range between 20 degrees and 50 degrees, 30 degrees and 60 degrees, 40 degrees and 70 degrees, or 50 degrees and 80 degrees.

Shifting the sole rear extension 500 closer to the toe end 150 or the heel end 160 provides one means of manipulating the mass properties of the assembled golf club head, and changing the ball flight trajectory. When manufacturing the first component 300, moving the rear extension 500 toward the toe end 150 or toward the heel end 160 can the change mass properties of the assembled club head 100. For example, the center of gravity of the club head 100 can be shifted towards the toe end 150 by angling or shifting the sole rear extension 500 toward the toe end 150. Similarly, the center of gravity of the club head 100 can be shifted towards the heel end 160 by angling or shifting the sole rear extension 500 towards the heel end 160.

Adjusting the angle of the sole rear extension 500 can position a greater amount of mass either heel-ward or toe-ward on the club head 100. By angling the sole rear extension 500, the mass located with the sole rear extension 500 (e.g. removeable weights) can be positioned closer to the heel end 160 to promote a draw bias shot shape (i.e. right-to-left ball flight), or can be positioned closer to the toe end 150 to promote a fade bias shot shape (i.e. left-to-right ball flight).

First Component Removable Weights

As illustrated in FIGS. 5 and 8, to further control of the mass properties of the assembled golf club head 100, a removable weight recess or weight port 540 and a removable weight 600 can be provided. The removable weight 600 can be positioned at an extreme rear of the club head 100 to provide the low and rear center of gravity location and increased moment of inertia. Specifically, the removable weight 600 can be positioned at an end of the sole rear extension 500 below the shelf 760 of the first component 300.

In some embodiments, as illustrated in FIG. 8, the removable weight 600 intersects with the YZ plane 193. In other embodiments, the removable weight 600 can be offset or positioned away from the YZ plane 193 or z-axis 196. In some embodiments, the removable weight 600 can be offset from the YZ plane 193 in a direction toward the heel end 160. In other embodiments, the removable weight 600 can be offset from the YZ plane 193 in a direction toward the toe end 150. The location of the removable weight 600 can influence the center of gravity location, moment of inertia, and/or golf ball flight characteristics.

The removable weight 600 can comprise a material such as steel, tungsten, aluminum, titanium, vanadium, chromium, cobalt, nickel, other metals, metal alloys, composite polymer materials or any combination thereof. In many embodiments, the removable weight 600 can be tungsten.

The removable weight 600 can comprise a mass. The mass of the removable weight 600 can range from 1.0 gram to 35 grams. In some embodiments, the mass of the removable weight 600 can range from 1.0 gram to 20 grams, or 20 grams to 35 grams. In some embodiments, the mass of the removable weight 600 can range from 1.0 gram to 15 grams, 5 gram to 20 grams, 10 grams to 25 grams, 15 grams to 30 grams, or 20 grams to 35 grams. For example, the mass of the removable weight 600 can be 1.0 gram, 1.5 grams, 2.0 grams, 3.0 grams, 4.0 grams, 5.0 grams, 6.0 grams, 7.0 grams, 8.0 grams, 9.0 grams, 10 grams, 11 grams, 12 grams, 13 grams, 14 grams, 15 grams, 16 grams, 17 grams, 18 grams, 19 grams, 20 grams, 21 grams, 22 grams, 23, grams, 24, grams, 25 grams, 26 grams, 27 grams, 28 grams, 29, grams, 30 grams, 31 grams, 32 grams, 33 grams, 34 grams, or 35 grams. In one example, the mass of the removable weight 600 can be 10 grams. In another example, the mass of the removeable weight 600 can be 13 grams.

The first component 300 can comprise a mass. The mass of the first component 300 can range from 160 grams to 200 grams. In some embodiments, the mass of the first component 300 can range from 160 grams to 180 grams, or 180 grams to 200 grams. For example, the mass of the first component 300 can be 160, 165, 170, 175, 180, 185, 190, 195, or 200 grams. The club head 100 can comprise a total mass. The total mass of the club head 100 can include the mass of the first component 300, the second component 200, and the removable weight 600. The total mass of the club head 100 can range from 190 grams to 230 grams. In some embodiments, the total mass of the club head 100 can range from 190 grams to 210 grams, or 210 grams to 230 grams. For example, the total mass of the club head 100 can be 190, 195, 200, 205, 210, 215, 220, 225, or 230 grams. In one example, the total mass of the club head 100 can be 210 grams.

The weight recess 540 is configured to receive the removable weight 600. The removable weight 600 can comprise a through hole located approximately at the center of the removable weight 600. The weight recess 540 can comprise a threaded bore for receiving a threaded fastener (not shown). The weight recess 540 can be recessed from the outer surface of the sole 120 to allow the removeable weight 600 to be flush with the outer surface of the sole 120 when the removable weight is secured within the weight recess 540. The threaded fastener can extend through the removeable weight to cooperate with the threaded bore to secure the removeable weight to the club head 100.

Figure 13:
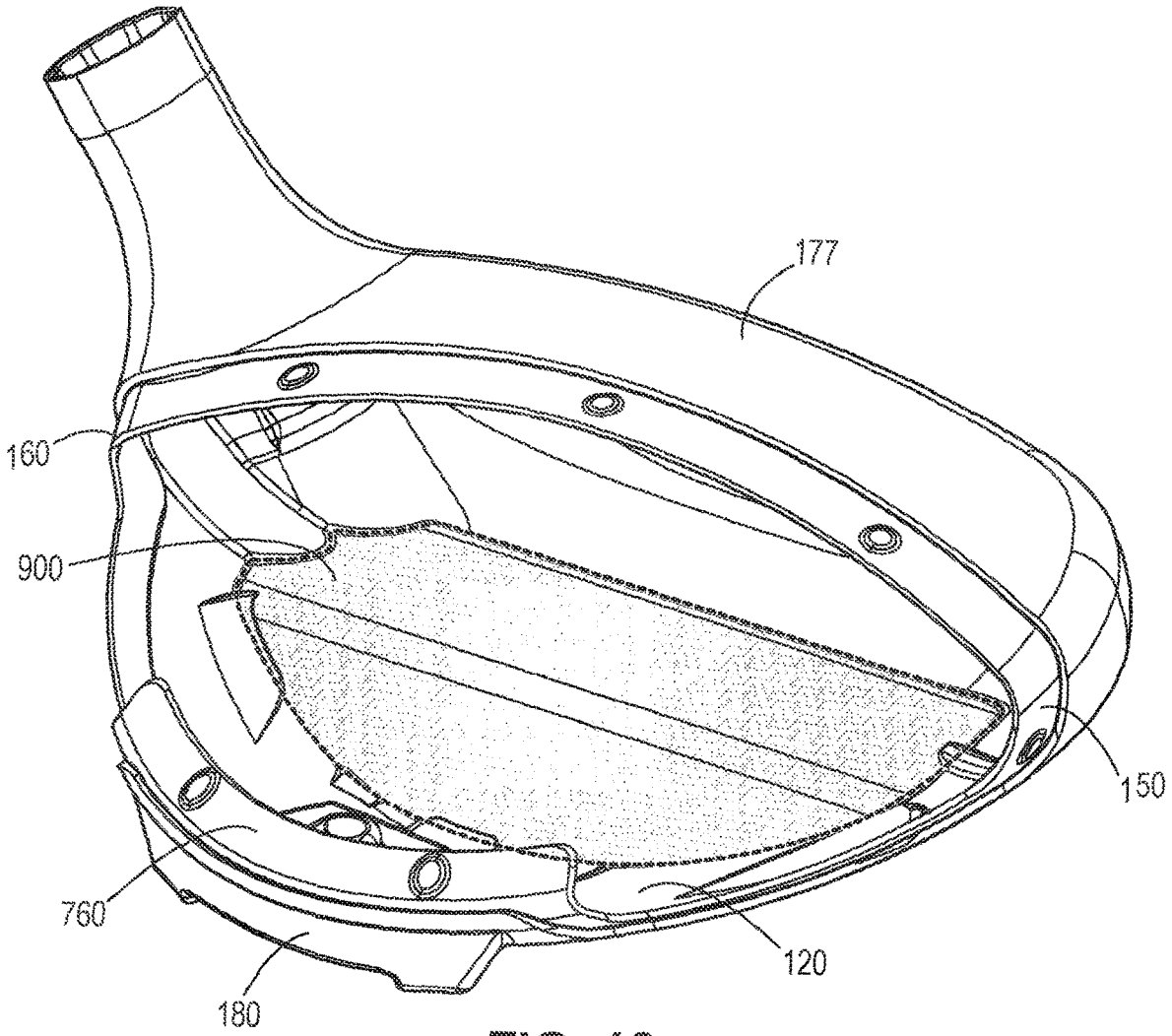
FIG. 13 illustrates a first embodiment of a mass pad for the golf club head of FIG. 1.
Figure 14:
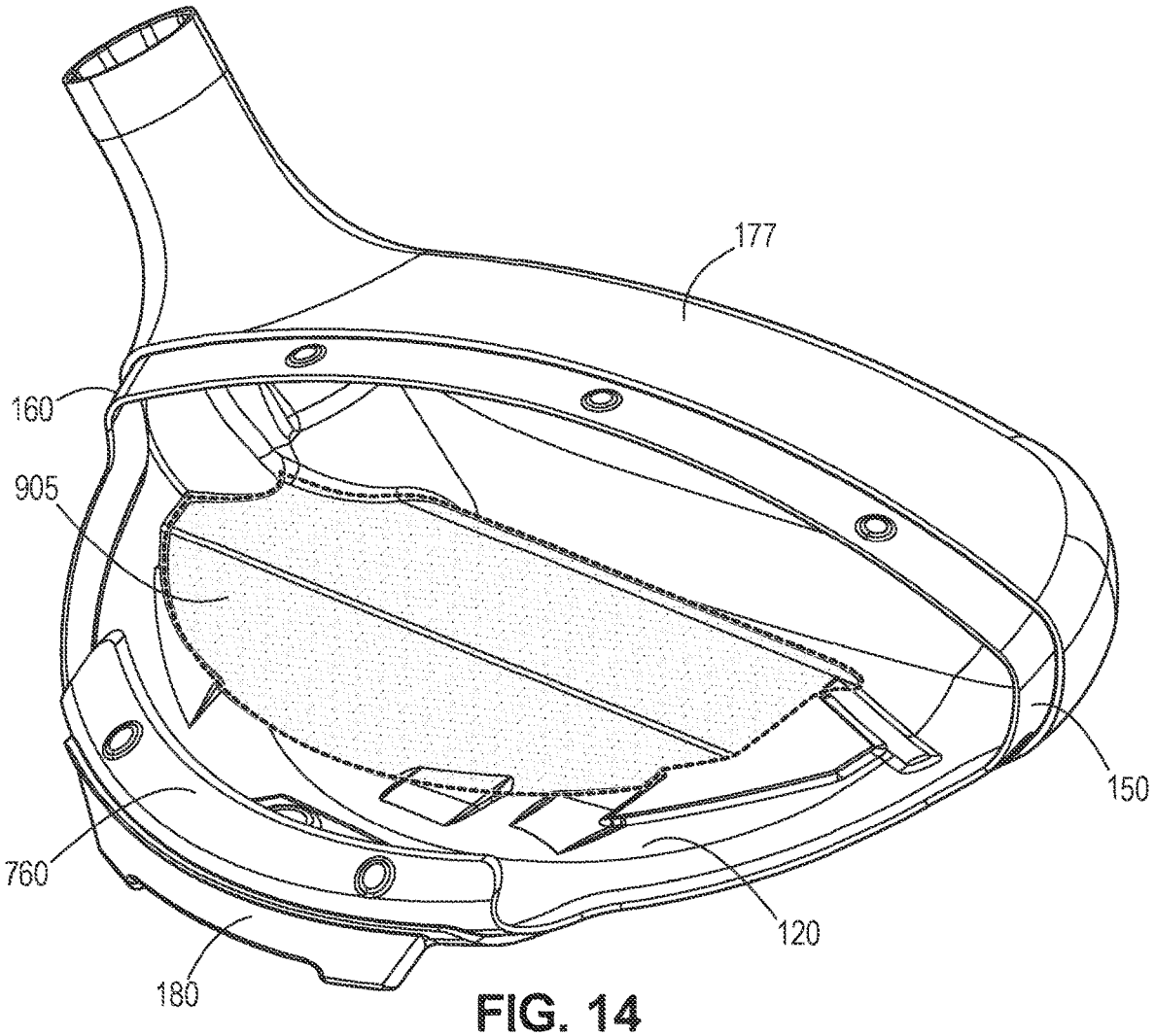
FIG. 14 illustrates a second embodiment of a mass pad for the golf club head FIG. 1.

As illustrated in FIGS. 13 and 14, to further control the golf ball spin performance of the assembled golf club head 100, mass pads (900, 905) can be provided in the sole 120. The mass pads (900, 905) can be integrally formed with the sole 120 (i.e. can be an increase in sole thickness). In other embodiments, the mass pads (900, 905) can be a separately formed portion that can be affixed to the sole 120 (e.g. can be affixed with epoxies or mechanical affixed with fasteners). The mass pads (900, 905) can be positioned centrally or in a forward portion of the sole 120 to provide spin control. In some embodiments, as illustrated in FIG. 14, the mass pad 905 can be shifted closer to the heel end 160. The mass pads (900, 905) can further lower the center of gravity to lower golf ball spin. The mass pads (900, 905) can comprise a mass. The mass of the mass pads (900,905) can range from 25 grams to 50 grams. In some embodiments, the mass of the mass pads (900, 905) can range from 25 grams to 40 grams, or 40 grams to 50 grams. In some embodiments, the mass of the mass pads (900, 905) can range from 25 grams to 35 grams, 30 grams to 40 grams, 35 grams to 45 grams, or 40 grams to 50 grams. For example, the mass of the mass pads (900, 905) can be 25, 30, 32, 33, 34, 35, 36, 37, 38, 39, 40, 45, or 50 grams. In one example, the mass of the mass pad 905 can be 33 grams. In another example, the mass of the mass pad 900 can be 37 grams.

As illustrated in FIGS. 13 and 14, the mass pads (900, 905) can be offset from the striking face 170. The mass pads (900, 905) can be offset from the striking face 170 by a distance ranging from 0.5 inch to 2.0 inch. In some embodiments, the mass pads (900, 905) can be offset from the striking face 170 by a distance ranging from 0.5 inch to 1.3 inch, 0.6 inch to 1.4 inch, 0.7 inch to 1.5 inch, 0.8 inch to 1.6 inch, 0.9 inch to 1.7 inch, 1.0 inch to 1.8 inch, 1.1 inch to 1.9 inch, or 1.2 inch to 2.0 inch. For example, the mass pads (900, 905) can be offset from the striking face 170 by a distance of 0.5, 0.6, 0.7, 0.8, 0.9, 1.0, 1.1, 1.2, 1.3, 1.4, 1.5, 1.6, 1.7, 1.8, 1.9, or 2.0 inch.

The mass pads (900, 905) can comprise a length measured in a striking face 170 to rear end 180 direction. The length of the mass pads (900, 905) can be measured parallel to the YZ plane 193 or the z-axis 196. The length of the mass pads (900, 905) can range from 1.0 inch to 2.5 inches. In some embodiments, the length of the mass pads (900, 905) can range from 1.0 inch to 1.75 inches, or 1.75 inches to 2.5 inches. In some embodiments, the length of the mass pads (900, 905) can range from 1.0 inch to 2.0 inches, 1.1 inches to 2.1 inches, 1.2 inches to 2.2 inches, 1.3 inches to 2.3 inches, 1.4 inches to 2.4 inches, or 1.5 inches to 2.5 inches. For example, the length of the mass pads (900, 905) can be 1.0, 1.1, 1.2, 1.3, 1.4, 1.5, 1.6, 1.7, 1.8, 1.9, 2.0, 2.1, 2.2, 2.3, 2.4, or 2.5 inches.

Further, the mass pads (900, 905) can comprise a percentage of a total sole surface area. The mass pads (900, 905) can comprise 20% to 50% of the total sole surface area. In some embodiments, the mass pads (900, 905) can comprise 20% to 35%, or 35% to 50% of the total sole surface area. In some embodiments, the mass pads (900, 905) can comprise 20% to 40%, 25% to 45%, or 30% to 50% of the total sole surface area. For example, the mass pads (900, 905) can comprise 20%, 25%, 28%, 30%, 32%, 35%, 38%, 40%, 42%, 45%, 48%, or 50% of the total sole surface area.

Second Component

As described above, the club head 100 comprises the second component 200 formed from a non-metallic, lightweight material. The second component 200 comprises a lightweight structure that wraps around the first component 300 to form portions of the crown 110, the sole 120, the skirt 130, the toe end 150, and the heel end 160 of the club head 100. The second component 200 can reduce the mass within the crown 110 and allows for additional discretionary mass to be distributed to the first component 300 or the removable weight 600. Further, the second component 200 can reduce the mass within the heel end 160, the toe end 150, the sole 120. By using a non-metallic second component 200 and taking the mass savings from the crown 110, the heel end 160, the toe end 150, the sole 120, the mass can be positioned into the removeable weight 600, the first component 300, and/or the mass pad 900 to lower the center of gravity, increase moment of inertia, decrease golf ball spin, and increase loft/launch angle. The combination of a wrap-around composite design, removable weights, and mass pads provides a high lofted fairway wood (15 degrees to 18 degrees) with a low center of gravity that is forgiving and a reduces golf ball spin by about 100 to 200 rpm over a club head devoid of the metallic first component, the non-metallic second component, and the mass pad.

Figure 9:
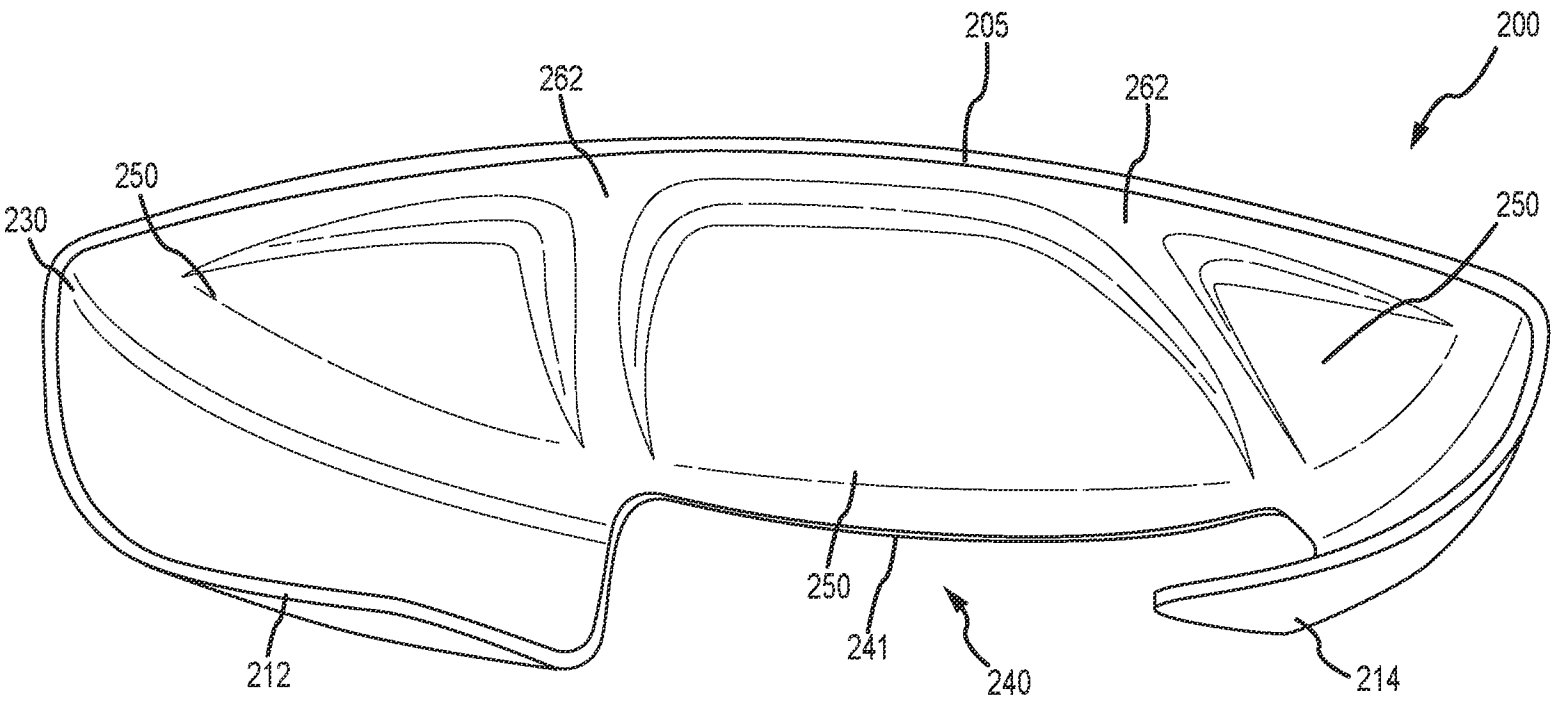
FIG. 9 illustrates a front perspective view of the second component of the club head of FIG. 1.
Figure 10:
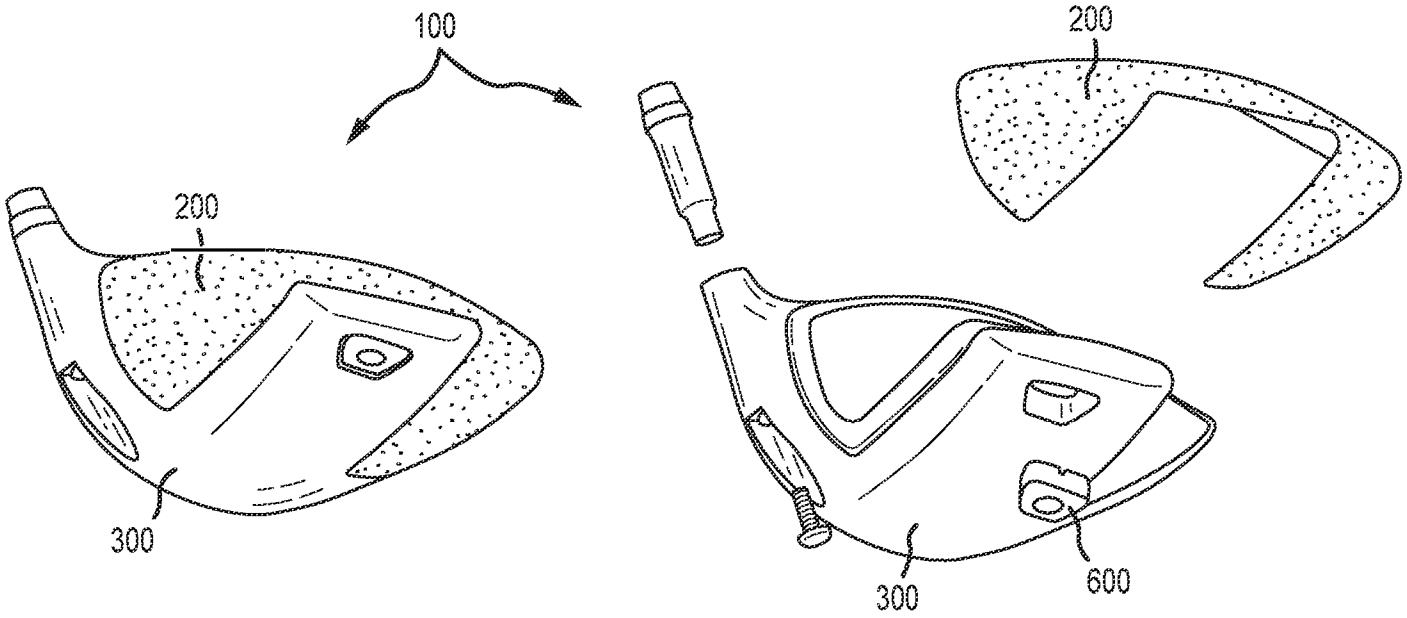
FIG. 10 illustrates an assembled and exploded view of the club head of FIG. 1.

As illustrated in FIGS. 1, 2, and 10, the second component 200 is configured to be secured to the first component 300 to form the hollow golf club head 100. As illustrated in FIGS. 1, 2, and 5, the second component 200 can comprise at least a portion of the crown 110, at least a portion of the sole 120, at least a portion of the skirt 130, and at least a portion of the rear end 180. Referring to FIG. 9, the second component 200 comprises a crown portion 205, a sole heel portion 214, a sole toe portion 212, a rear cutout 240, and a second component skirt portion 230. The crown portion 205 can be configured to abut the crown return portion 400 of the first component 300. The sole heel portion 214 can be configured to abut the sole rear extension 500 and the heel extension 710 of the first component 300. The sole toe portion 212 can be configured to abut the sole rear extension 500 and the toe extension 720 of the first component 300. The rear cutout 240 can be configured to abut the shelf 760 of the first component 300. As illustrated in FIG. 9, the rear cutout 240 defines a rear cutout rearward edge 241 configured to abut the shelf forward edge 761.

In some embodiments, as illustrated in FIG. 2, the rear cutout 240 of the second component 200 can be secured to the vertical lip 750, wherein the second component 200 abuts the shelf 760 within the boundary of the crown 110. Specifically, referring to FIG. 2, the rear cutout rearward edge 241 can abut the shelf forward edge 761 within the boundary of the crown 110. In other embodiments, the rear cutout 240 of the second component 200 can be secured to the vertical lip 750, wherein the second component 200 abuts the shelf 760 within the boundary of the skirt 130 (i.e. the second component 200 wraps or extends beyond the crown 110 and into the skirt 130).

Figure 11:
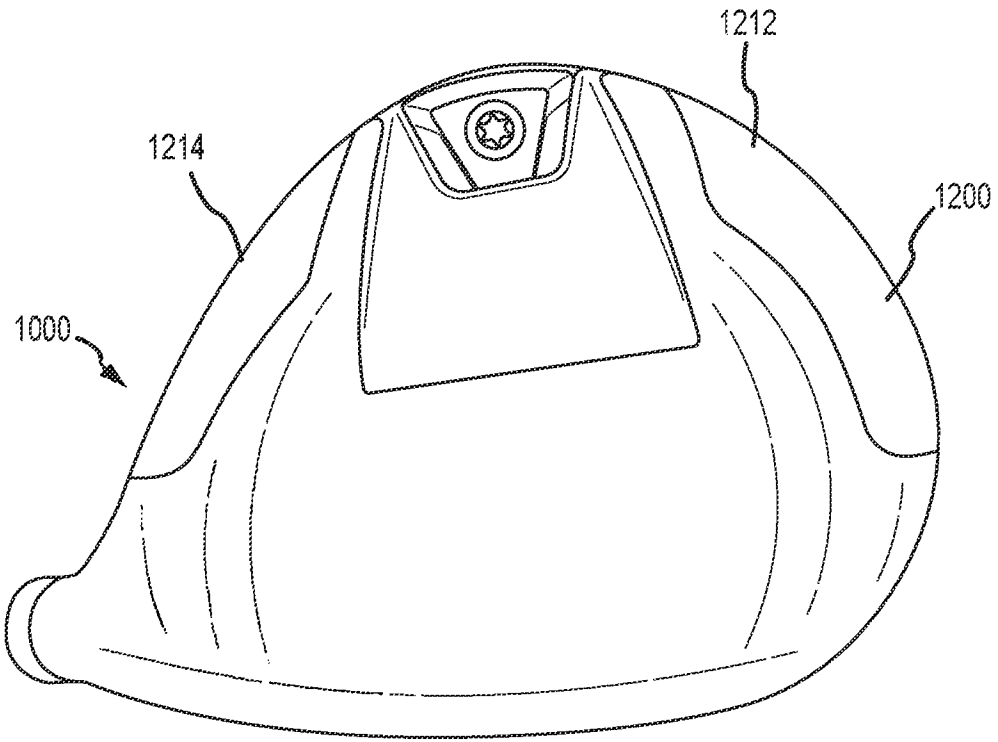
FIG. 11 illustrates a sole view of a wood-type club head comprising a first component and a second component according to a second embodiment.

As illustrated in FIGS. 5 and 9, the sole heel portion 214 and the sole toe portion of the second component 200 can comprise a general triangular shape. The sole heel portion 214 of the second component 200 can be positioned between the sole rear extension 500 and the heel extension 710. The sole toe portion 212 of the second component 200 can be positioned between the sole rear extension 500 and the toe extension 720. In other embodiments, the sole portions formed by the second component 200 can comprise a circular shape, square shape, oval shape, any other polygonal shape, or a shape with at least one curved surface, complementary to the sole portions of the first component 300. In other embodiments, as illustrated in FIG. 11, a second embodiment of a wood-type club head 1000 illustrates a different second component sole portion shape. The club head 1000 can comprise a second component 1200 comprising a sole heel portion 1214 and a sole toe portion 1212. The sole portions (1212, 1214) of the second component 1200 can comprise a reduced portion of the club head 1000 sole compared to the sole portions (212, 214) of the second component 200. The sole portions (1212, 1214) can comprise a general curvilinear shape that follows the contour of the skirt of the club head 1000. Referring back to the club head 100, the second component 200 can comprise a single monolithic piece. For example, the second component 200 can be formed by injection molding a single monolithic piece comprising a single material.

Further, the positioning of the sole heel portion 214 and the sole toe portion 212 can be important in saving weight and increasing the overall discretionary mass. The sole heel portion 214 and the sole toe portion 212 of the second component 200 can comprise a percentage of a total surface area of the sole 120. In some embodiments, the sole toe portion 212 can comprise a greater percentage of the total sole surface area than the sole heel portion 214. In some embodiments, the sole toe portion 212 and the sole heel portion 214 can comprise a similar or equal percentage of the total sole surface area.

In embodiments where the sole toe portion 212 and the sole heel portion 214 comprise similar or equal percentages of the sole surface area, the sole portions (212, 214) can comprise 1% to 5% of the total surface area of the sole 120. For example, the sole portions (212, 214) can comprise 1%, 2%, 3%, 4%, or 5% of the total surface area of the sole 120. In other embodiments, the sole portions (212, 214) can comprise less than 5%, less than 4%, less than 3%, less than 2%, or less than 1% of the total surface area of the sole 120.

In embodiments where the sole toe portion 212 can comprise a greater percentage of the total sole surface area than the sole heel portion 214, the sole toe portion 212 can comprise 10% to 20% of the total sole surface area. In some embodiments, the sole toe portion 212 can comprise 10% to 15%, or 15% to 20% of the total sole surface area. For example, the sole toe portion 212 can be 10%, 11%, 12%, 13%, 14%, 15%, 16%, 17%, 18%, 19%, or 20% of the total sole surface area. In embodiments where the sole toe portion 212 can comprise a greater percentage of the total sole surface area than the sole heel portion 214, the heel sole portion 214 can comprise 1% to 5% of the total sole surface area. For example, the heel sole portion 214 can comprise 1%, 2%, 3%, 4%, or 5% of the total sole surface area. In other embodiments where the sole toe portion 212 can comprise a greater percentage of the total sole surface area than the sole heel portion 214, the sole heel portion 214 can comprise less than 5%, less than 4%, less than 3%, less than 2%, or less than 1% of the total surface area of the sole 120.

Alternately, the second component 200 can comprise a plurality of separately formed portions, which may be subsequently permanently joined by adhesives, sonic welding, fusion bonding, or other permanent joining methodologies appropriate to the materials used in forming the plurality of separately formed portions. For example, the second component crown portion 205, toe portion 212, and heel portion 214 may be formed separately from the same or different materials. The second component portions (205, 212, and 214) may then be adhesively joined to form the complete second component 200. Forming the second component 200 as separate portions can be advantageous for certain materials. For example, forming separate portions can be advantageous when using materials such as bi-directional carbon fiber prepreg materials. Bi-directional carbon fiber prepreg does not easily accommodate small curvatures within the geometry of the second component 200, where a single piece construction is not easily manufacturable. Using such a material may produce a need to form separate sole portions 212 and 214 that are later joined by adhesives or other methods to form the assembled second component 200.

The second component 200 of the club head 100 can comprise a thickness. The thickness of the second component 200 at the crown portion 205, the sole heel portion 214, and the sole toe portion 212 can be similar or equal. In other embodiments, the thickness of the second component 200 at the crown portion 205, the sole heel portion 214, and the sole toe portion 212 can be different. In other embodiments still, the thickness of the second component 200 at the crown portion 205 can be less than the thickness at the sole heel portion 214 and the sole toe portion 212. In many embodiments, the thickness of the second component 200 can range from 0.025 inch to 0.075 inch. In some embodiments, the thickness of the second component 200 can range from 0.025 inch to 0.05 inch, or 0.05 inch to 0.075 inch. In some embodiments, the thickness of the second component 200 can range from 0.03 inch to 0.06 inch, 0.035 inch to 0.065 inch, 0.045 inch to 0.07 inch, or 0.05 inch to 0.075 inch. For example, the thickness of the second component 200 can be 0.025, 0.03, 0.04, 0.045, 0.05, 0.055, 0.06, 0.07, or 0.075 inch. In one example, the thickness of the second component 200 can range from 0.025 inch to 0.05 inch. The thickness of the second component 200 can further vary within the crown 110, the sole 120, the heel end 160, the toe end 150, and the skirt 130. For example, in a single embodiment, the thickness of the second component 200 can differ across the crown 110, the sole 120, the heel end 160, the toe end 150, and skirt portion of the second component 200.

In some embodiments, as illustrated in FIGS. 2 and 9, the second component 200 can further comprise ribs or thicken sections, and thinned sections. As used herein, when referring to ribs or thicken sections, the present disclosure is intending to refer to a portion of the second component 200 that has a varying thickness (measured normal to the outer surface of the component) that is comparatively thicker than a second, non-thickened area of the second component 200.

Ribs or thicken sections can provide additional strength and/or stiffness to the club head through various mechanisms. First, the thickened ribs/sections may act as a strut/gusset that provides a structural framework for the component. In this manner, the design of the structure itself can promote strength. Additionally, the presence of the thickened section may be used during molding to assist in controlling the direction, speed, and uniformity of the polymer flow. In doing so, the orientation of embedded fibers may be controlled so that any anisotropic parameters of the material, itself, are oriented to support the club head's intended purpose. In this sense, the thickened sections can provide both an engineered structure and an engineered material. Finally, in some embodiments, the first component may include a buttressing feature, such as an upstanding strut that is configured to be affixed to the second component. In such a design, the thickened sections may provide a suitable coupling location as the thickened material may distribute any transmitted loads without the risk of fatiguing or fracturing the comparatively thinner sections.

In some embodiments, as illustrated in FIG. 9, the second component 200 further comprises a plurality of reduced thickness sections 250. The reduced thickness sections 250 can be positioned on portions of the second component 200 that form the crown 110, the sole 120, the heel end 160, or the toe end 150. As illustrated in FIG. 9, the reduced thickness sections 250 can be positioned on the portion of the second component 200 that forms the crown 110. The second component 200 further comprises a plurality of second component ribs 262. The plurality of ribs 262 can comprise two ribs, three ribs, four ribs, five ribs, or more than five ribs. The ribs 262 can be positioned between the reduced thickness sections 250. The locations of the ribs 262 on the second component 200 can define portions of the second component 200 that define the greatest thickness. In some embodiments, the second component ribs 262 can be similar to the ribs as described in U.S. application Ser. No. 15/076,511, now U.S. Pat. No. 9,700,768, which is hereby incorporated by reference in its entirety. The second component ribs 262 can reduce stress on the club head 100 and improve sound during an impact.

The plurality of reduced thickness sections 250 comprise a thickness. In many embodiments, the thickness of the reduced thickness sections 250 can range from 0.02 inch to 0.05 inch. In some embodiments, the thickness of the reduced thickness sections 250 can range from 0.02 inch to 0.035 inch, or 0.035 to 0.05 inch. For example, the thickness of the reduced thickness sections 250 can be 0.02, 0.025, 0.03, 0.035, 0.04, 0.045, or 0.05 inch. In one example, the thickness of the reduced thickness sections 250 can range from 0.03 to 0.05 inch.

The ribs 262 comprise a thickness. In many embodiments, the thickness of the ribs 262 can range from 0.04 to 0.07 inch. In some embodiments, the thickness of the ribs 262 can range from 0.04 inch to 0.055 inch, or 0.055 inch to 0.07 inch. For example, the thickness of the ribs 262 can be 0.04, 0.05, 0.06, or 0.07 inch. In one example, the thickness of the ribs 262 can range from 0.04 to 0.055 inch. In other embodiments, the second component 200 can be devoid of ribs 262 and reduced thickness sections 250.

The second component 200 comprises a mass percentage of the overall mass of the golf club head 100. The mass percentage of the second component 200 can range from 3% to 15% of the overall mass of the golf club head 100. For example, the mass percentage of the second component may be 3%, 4%, 5%, 6%, 7%, 8%, 9%, 10%, 11%, 12%, 13%, 14%, or 15% of the overall mass of the golf club head 100. Stated another way, the mass of the second component 200 can range from 5 to 20 grams. In some embodiments, the mass of the second component 200 can range from 5 to 12 grams, or 12 grams to 20 grams. For example, the mass of the second component 200 can be 5, 6, 7, 8, 9, 10, 11, 12, 13, 14, or 15 grams. In one example, the mass of the second component 200 can be 8 grams.

Second Component Materials

The second component 200 comprises a less dense material than the material of the first component 300. In some embodiments, the second component 200 can comprise a composite formed from polymer resin and reinforcing fiber. The polymer resin can comprise a thermoset or a thermoplastic. The second component 200 composite can be either a filled thermoplastic (FT) or a fiber-reinforced composite (FRC). In some embodiments, the second component 200 can comprise a FT bonded together with a FRC. Filled thermoplastics (FT) are typically injection molded into the desired shape. As the name implies, filled thermoplastics (FT) can comprise a thermoplastic resin and randomly oriented, non-continuous fibers. In contrast, fiber-reinforced composites (FRCs) are formed from resin-impregnated (prepreg) sheets of continuous fibers. Fiber-reinforced composites (FRCs) can comprise either thermoplastic or thermoset resin.

In embodiments with a thermoplastic resin, the resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, polyphenylene sulfides (PPS), polycarbonates, engineering polyurethanes, and/or other similar materials. Although strength and weight are the two main properties under consideration for the composite material, a suitable composite material may also exhibit secondary benefits, such as acoustic properties. In some embodiments, PPS and PEEK are desirable because they emit a generally metallic-sounding acoustic response when the club head is impacted.

The reinforcing fiber can comprise carbon fibers (or chopped carbon fibers), glass fibers (or chopped glass fibers), graphene fibers (or chopped graphite fibers), or any other suitable filler material. In other embodiments, the composite material may comprise any reinforcing filler that adds strength, durability, and/or weighting.

The density of the composite material (combined resin and fibers), which forms the second component 200, can range from about 1.15 g/cc to about 2.02 g/cc. In some embodiments, the composite material density ranges between about 1.20 g/cc and about 1.90 g/cc, about 1.25 g/cc and about 1.85 g/cc, about 1.30 g/cc and about 1.80 g/cc, about 1.40 g/cc and about 1.70 g/cc, about 1.30 g/cc and about 1.40 g/cc, or about 1.40 g/cc to about 1.45 g/cc.

Filled Thermoplastic (FT)

In a FT material, the polymer resin should preferably incorporate one or more polymers that have sufficiently high material strengths and/or strength/weight ratio properties to withstand typical use while providing a weight savings benefit to the design. Specifically, it is important for the design and materials to efficiently withstand the stresses imparted during an impact between the strike face and a golf ball, while not contributing substantially to the total weight of the golf club head. In general, the polymers can be characterized by a tensile strength at yield of greater than about 60 MPa (neat). When the polymer resin is combined with the reinforcing fiber, the resulting composite material can have a tensile strength at yield of greater than about 110 MPa, greater than about 180 MPa, greater than about 220 MPa, greater than about 260 MPa, greater than about 280 MPa, or greater than about 290 MPa. In some embodiments, suitable composite materials may have a tensile strength at yield of from about 60 MPa to about 350 MPa.

In some embodiments, the reinforcing fiber comprises a plurality of distributed discontinuous fibers (i.e. "chopped fibers"). In some embodiments, the reinforcing fiber comprises a discontinuous "long fibers," having a designed fiber length of from about 3 mm to 25 mm. In some embodiments the discontinuous "long fibers" have a designed fiber length of from about 3 mm to 14 mm. For example, in some embodiments, the fiber length is about 12.7 mm (0.5 inch) prior to the molding process. In another embodiment, the reinforcing fiber comprises discontinuous "short fibers," having a designed fiber length of from about 0.01 mm to 3 mm. In either case (short or long fiber), it should be noted that the given lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the composite material may have a fiber length of from about 0.01 mm to about 25 mm or from about 0.01 mm to about 14 mm.

The composite material may have a polymer resin content of about 40% to about 90% by weight, or from about 55% to about 70% by weight. The composite material of the second component can have a fiber content between about 10% to about 60% by weight. In some embodiments, the composite material has a fiber content between about 20% to about 50% by weight, between 30% to 40% by weight. In some embodiments, the composite material has a fiber content of between about 10% and about 15%, between about 15% and about 20%, between about 20% and about 25%, between about 25% and about 30%, between about 30% and about 35%, between about 35% and about 40%, between about 40% and about 45%, between about 45% and about 50%, between about 50% and about 55%, or between about 55% and about 60% by weight.

In embodiments where the second component 200 comprises a filled thermoplastic (FT) material, the second embodiment 200 can be injection molded out of composite pellets comprising both the polymer resin and the reinforcing fibers. The reinforcing fibers can be embedded within the resin prior to the injection molding process. The pellets can be melted and injected into an empty mold to form the second component 200. The FT composite material can have a melting temperature of between about 210° C. to about 280° C. In some embodiments, the composite material can have a melting temperature of between about 250° C. and about 270° C.

In embodiments with FT material second components 200, at least 50% of the fibers can be aligned roughly front-to-back in a center region of the crown 110. In other words, the fibers can be aligned roughly perpendicular to the striking face 170. FT materials exhibit greatest strength in the direction of fiber alignment. Therefore, having the fibers oriented roughly front-to-back in the crown 110 can increase the durability of the club head in the front-to-rear direction. The fiber alignment can be correspond to the direction of material flow within the mold during the injection molding process.

When the club head 100 strikes a golf ball, the impact can cause the mass at the rear end 180 of the rear extension 500 to displace vertically, in the Y-axis 192 direction. At impact, the sole portion rear extension 500 will bend upwards and exert stress on the second component crown portion 205. The crown portion is compressed between the first component rear extension 500 and a front portion of the first component 300. Therefore, in embodiments with a FT second component 200, aligning the fibers with the direction of compression stress that is expected at impact lowers the likelihood of failure within the composite second component 200.

In some embodiments, the second component 200 can be formed from a long fiber reinforced TPU material (an example FT material). The long fiber TPU can comprise about 40% long carbon fiber by weight. The long fiber TPU can exhibit a high elastic modulus, greater than that of short carbon fiber compounds. The long fiber TPU can withstand high temperatures, making it suitable for use in a golf club head that is used and/or stored in a hot climate. The long fiber TPU further exhibits a high toughness, allowing it to serve well as a replacement for traditionally metal components. In some embodiments, the long fiber TPU comprises a tensile modulus between about 26,000 MPa and about 30,000 MPa or between about 27,000 MPa and about 29,000 MPa. In some embodiments, the long fiber TPU comprises a flexural modulus between about 21,000 MPa and about 26,000 MPa or between about 22,000 MPa and 25,000 MPa. The long fiber TPU material can exhibit an tensile elongation (at break) of between about 0.5% and about 2.5%. In some embodiments, the tensile elongation of the composite TPU material can be between about 1.0% and about 2.0%, between about 1.2% and about 1.4%, between about 1.4% and about 1.6%, between about 1.6% and about 1.8%, between about 1.8% and about 2.0%.

Fiber-Reinforced Composite (FRC)

In some embodiments, the second component 200 may comprise fiber-reinforced composite (FRC) materials. FRC materials generally include one or more layers of a uni- or multi-directional fiber fabric that extend across a larger portion of the polymer. Unlike the reinforcing fibers that may be used in filled thermoplastic (FT) materials, the maximum dimension of fibers used in FRCs may be substantially larger/longer than those used in FT materials, and may have sufficient size and characteristics so they may be provided as a continuous fabric separate from the polymer. When formed with a thermoplastic polymer, even if the polymer is freely flowable when melted, the included continuous fibers are generally not. The reinforcing fibers can comprise an areal weight (weight per length-by-width area) between 75 g/m2 and 150 g/m2.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. In some embodiments, the resin content of the FRC can be between 24% and 45% by volume.

FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into a final shape.

A FRC second component 200 can be comprise a plurality of layers (also called a plurality of lamina). Each layer can comprise and/or be the same thickness as a prepreg. Each layer the plurality of layers can comprise either a unidirectional fiber fabric (UD) or a multi-directional fiber fabric (sometimes called a weave). In some embodiments, the plurality of layers can comprise at least three UD layers. The second and third layers can be angled relative to a base layer. For a base layer oriented at 0 degrees, the second and third layers can be oriented at +/−45 degrees from the base layer. In some embodiments, the layers can be oriented at 0, +45, −45, +90, −90 in any suitable order. In some embodiments, the plurality of layers comprises at least one multi-directional weave layer, typically positioned as the top layer to improve the appearance of the FRC second component 200.

Mixed-Material

Figure 15:
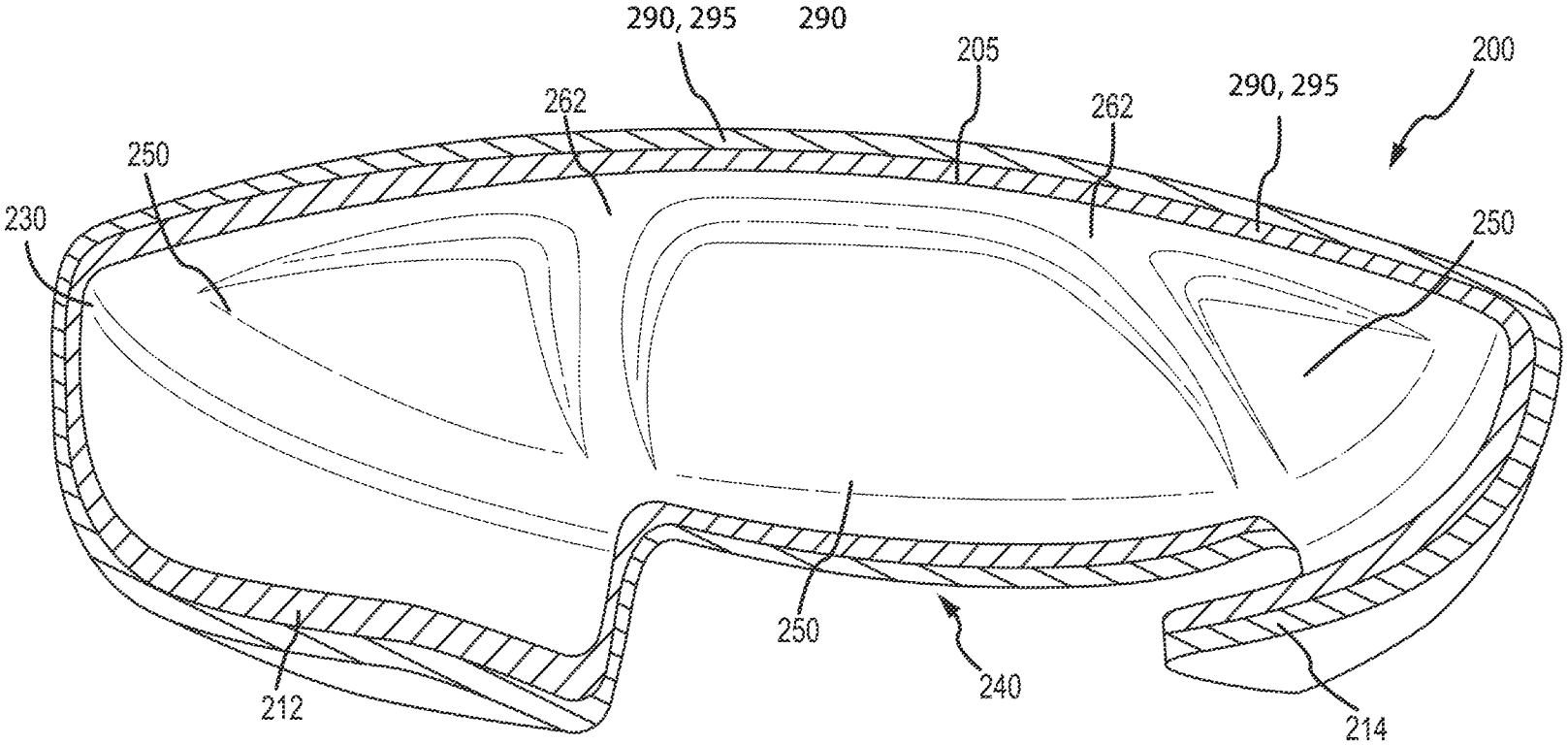
FIG. 15 illustrates a front perspective view of the second component of the club head of FIG. 1.

The second component 200 may have a mixed-material construction that includes both a fiber-reinforced composite resilient layer 290 and a molded thermoplastic structural layer 295, as best shown in FIG. 15. In some preferred embodiments, the molded thermoplastic structural layer 295 may be formed from a filled thermoplastic material (FT). As described above, the FT can comprise a discontinuous glass, carbon, or aramid polymer fiber filler embedded throughout a thermoplastic material. The thermoplastic resin can be a TPU, such as, for example, polyphenylene sulfide (PPS), polyether ether ketone (PEEK), or a polyamide such as PA6 or PA66. The fiber-reinforced composite resilient layer 290 can comprise a woven glass, carbon fiber, or aramid polymer fiber reinforcing layer embedded in a polymeric resin (or matrix). The polymeric resin of the resilient layer can be a thermoplastic or a thermoset.

In some embodiments, the polymeric resin of fiber-reinforced composite resilient layer is the same thermoplastic material as the resin of the molded thermoplastic structural layer 295. In other words, the fiber-reinforced resilient layer 290 and the molded structural layer can comprise a common thermoplastic resin. Forming the resilient and structural layers with a common thermoplastic resin allows for a strong chemical bond between the layers. In these embodiments, the resilient and structural layers can be bonded without the use of an intermediate adhesive. In one particular embodiment, the second component 200 resilient layer can comprise a woven carbon fiber fabric embedded in a polyphenylene sulfide (PPS), and the second component (200) structural layer can comprise a filled polyphenylene sulfide (PPS) polymer. In alternate embodiments, the second component 200 can be extruded, injection blow molded, 3-D printed, or any other appropriate forming means.

Method of Manufacture

The first component 300 can be formed from a metal material such as steel, stainless steel, tungsten, aluminum, titanium, vanadium, chromium, cobalt, nickel, other metals, or metal alloys. In some embodiments, the first component 300 can comprise a Ti-8Al-1Mo-1V alloy, or a 17-4 stainless steel. In some embodiments, the first component 300 and/or the striking face 170 can be formed from C300, C350, Ni (Nickel)-Co(Cobalt)-Cr(Chromium)-Steel Alloy, 565 Steel, AISI type 304 or AISI type 630 stainless steel, 17-4 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 titanium alloy, an amorphous metal alloy, or other similar metals. In many embodiments wherein the golf club head 100 is a fairway wood-type club head, the first component 300 can comprise a stainless steel material.

Figure 12:
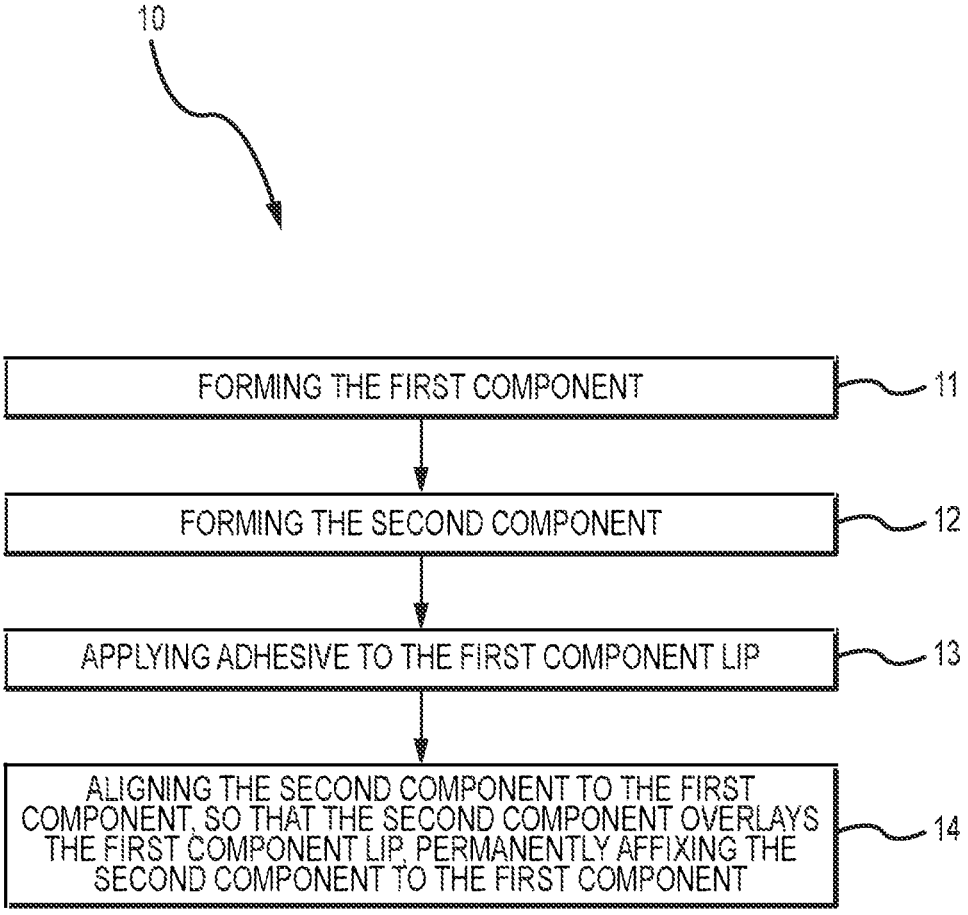
FIG. 12 illustrates a first method of manufacturing a golf club head.

Referring to FIG. 12, a first method 10 of manufacturing the golf club head 100 comprises forming the first component 300 (Step 11), forming the second component 200 (Step 12), applying an adhesive to a first component lip 450 (Step 13), aligning the second component 200 to the first component 300, fitting the second component 200 to the first component 300 so the second component 200 overlays the lip 450, and allowing the adhesive to set, permanently affixing the second component 200 to the first component 300 to form the hollow golf club head 100 (Step 14). Step 11 can further include forming weight ports for receiving removable weights 600, and forming mass pads (900, 905) in a central portion of the sole 120 or in a forward portion of the sole 120.

The first component 300 can be secured to the second component 200 at the first component lip 450 to form the body of the golf club head 100. The first component lip 450 including the crown portion lip 455, the sole lip 460, and the vertical lip 750 are entirely covered by the second component 200 when the first component 300 is secured to the second component 200 to form the body of the golf club head 100. The second component rear cutout 240 comprises the skirt portion 230 that forms a portion of the skirt 130 of the club head 100. When the first component 300 is secured to second component 200 at the first component lip 450, a portion of the second component 200 (i.e. at the rear cutout 240) is joined along the shelf 760 of the first component 300.

The first component 300 may be secured to the second component 200 by means of an adhesive. In many embodiments, an adhesive such as glue, epoxy, epoxy gasket, tape (e.g., VHB tape), or any other adhesive materials can be disposed at the junction of the second component 200 and the first component lip 450. In some embodiments, the first component bonding features 457 on the first component lip 450 can abut the second component 200, leaving a clearance gap between the first component lip 450 and the second component 200. This clearance gap can house the adhesive. The clearance gap can have a uniform height or thickness due to the bonding features 457 having uniform heights. This uniform height of the clearance gap can create an even bond between the first and second components. In other embodiments, the second component 200 can be secured to the first component 300 by fasteners, clips, press fit, or any other appropriate mechanical means of attachment (not shown). In other embodiments, the first component 300 may be secured to the second component 200 by an adhesive in conjunction with an appropriate mechanical means of attachment. In other embodiments, the first component 300 may be secured to the second component 200 using laser welding to heat the second component 200 material to cause it to adhere to the first component 300 material.

The lip 450 of the first component 300 is offset from the outer surface of the first component 300 to allow the second component 200 to sit flush with the first component. Specifically, when the club head 100 is assembled, the outer surface of the second component 200 can be flush with the outer surface of the first component 300. The lip 450 of first component 300 allows the outer surfaces of the first component 300 and the second component 200 to not be offset from each other.

Center of Gravity Location and Moment of Inertia

As described above, the metallic first component 300 and the non-metallic wrap around second component 200 allows for a low and back center of gravity and increased moment of inertia. These advantages can be achieved by increasing the amount of discretionary mass. Increasing discretionary mass can be achieved by optimizing the first and second component (300, 200) materials and/or reducing the mass of the crown 110. As described above, the majority of the crown 110 can be formed by the non-metallic second component 200 that reduces crown mass and repositions the mass to the first component 300 or the removable weight 600. The movement of mass shifts the center of gravity low toward the sole 120 of the club head 100, and back toward the rear end 180 of the club head 100. The multi-component club head design formed from multiple materials aims to have a low and back center of gravity to 1) reduce golf ball backspin, (2) maintain or improve momentum transfer between the club head and the golf ball, and (3) increase golf ball speed and distance. The combination of a wrap-around composite design, removable weights, and mass pads provides a high lofted fairway wood (15 degrees to 18 degrees) with a low center of gravity that is forgiving and a reduces golf ball spin by about 100 to 200 rpm over a club head devoid of the metallic first component, the non-metallic second component, and the mass pad. The fairway wood described in this disclosure does not comprise a sole channel to control or decrease golf ball spin. The fairway wood described in this disclosure utilizes the wrap-around composite design, removeable weights, and mass pads instead of a sole channel to control golf ball spin.

Further, the multi-component club head 100 comprising the metallic first component 300, the non-metallic wrap around second component 200, the removeable weight 600, and the mass pads 900 or 905 allows for a balance between moment of inertia, center of gravity position, golf ball spin, and launch angle. The movement of mass can influence one or more of these characteristics. The non-metallic (e.g. composite) second component 200 provides the ability to move a greater amount of mass compared to an all-metal club head to address the performance characteristics of moment of inertia, center of gravity position, golf ball spin, and launch angle at the same time. The non-metallic second component 200 allows for mass to be positioned lower and rearward to provide a low and rear center of gravity and increased moment of inertia (e.g. mass can be placed in removeable weight 600 or the first component 300). The non-metallic second component 200 allows for mass to be positioned forward or closer to the striking face 170 to further lower the center of gravity position and lower golf ball spin (e.g. mass can be placed in a mass pad 900 or 905). The mass placement to achieve a low and rear center of gravity position allows the launch/loft angle to increase compared to an all-metal club head. The multi-component club head 100 can provide a 1 to 3 degree increase in loft/launch angle compared to an all-metal club head. The increased launch/loft angle of the multi-component club head 100 allows for higher golf ball lift above the ground.

The multiple material design of the club head 100 can reduce crown 110 mass compared to an all-metal club head comprising a metallic crown. The reduction of crown 110 mass (i.e. increased discretionary mass) can be positioned to other portions of the club head 100 such as the first component 300 or the removable weight 600. In some embodiments, the amount of discretionary mass saved from reducing the crown 110 mass can range from 2 to 15 grams. In some embodiments, the amount of discretionary mass removed from the crown 110 can range from 2 to 5 grams, 5 to 10 grams, or 10 to 15 grams. For example, the amount of discretionary mass removed from the crown 110 can be 2, 3, 4, 5, 6, 7, 8, 9, 10, 11, 12, 13, 14, or 15 grams. In one example, the amount of discretionary mass removed from the crown 110 can range from 5 to 10 grams.

Further, the club head 100 comprises a moment of inertia Ixx about the x-axis (i.e. crown-to-sole moment of inertia), and a moment of inertia Iyy about the y-axis (i.e. heel-to-toe moment of inertia). In many embodiments, the crown-to-sole moment of inertia Ixx and the heel-to-toe moment of inertia Iyy are increased or maximized based on the amount of discretionary mass available to the club head designer.

In many embodiments, the club head 100 comprises a crown-to-sole moment of inertia Ixx greater than approximately 200 $g \cdot in^2$, greater than approximately 210 $g \cdot in^2$, greater than approximately 220 $g \cdot in^2$, greater than approximately 230 $g \cdot in^2$, greater than approximately 240 $g \cdot in^2$, greater than approximately 250 $g \cdot in^2$, greater than approximately 260 $g \cdot in^2$, greater than approximately 270 $g \cdot in^2$, greater than approximately 280 $g \cdot in^2$, or greater than approximately 290 $g \cdot in^2$.

In some embodiments, the crown-to-sole moment of inertia Ixx can range from 220 to 270 $g \cdot in^2$, 230 to 280 $g \cdot in^2$, 240 to 290 g·in$^2$. In other embodiments, the crown-to-sole moment of inertia Ixx can range from 220 to 270 g·in$^2$, 230 to 260 g·in$^2$, 240 to 270 g·in$^2$, 250 to 280 g·in$^2$, or 260 to 290 g·in$^2$. In other embodiments still, the crown-to-sole moment of inertia Ixx can range from 220 to 240 g·in$^2$, 230 to 250 g·in$^2$, 240 to 260 g·in$^2$, 250 to 270 g·in$^2$, 260 to 280 g·in$^2$, or 270 to 290 g·in$^2$. For example, the crown-to-sole moment of inertia Ixx can be 200, 210, 220, 230, 240, 250, 260, 270, 280, or 290 g·in$^2$.

In many embodiments, the club head comprises a heel-to-toe moment of inertia Iyy greater than approximately 440 g·in$^2$, greater than approximately 450 g·in$^2$, greater than approximately 460 g·in$^2$, greater than approximately 470 g·in$^2$, greater than approximately 480 g·in$^2$, greater than approximately 490 g·in$^2$, greater than approximately 500 g·in$^2$, greater than approximately 510 g·in$^2$, or greater than approximately 520 g·in$^2$.

In some embodiments, the heel-to-toe moment of inertia Iyy can range from 440 to 490 g·in$^2$, 450 to 500 g·in$^2$, 460 to 510 g·in$^2$, or 470 to 520 g·in$^2$. In other embodiments, the heel-to-toe moment of inertia Iyy can range from 440 to 470 g·in$^2$, 450 to 480 g·in$^2$, 460 to 490 g·in$^2$, 470 to 500 g·in$^2$, 480 to 510 g·in$^2$, or 490 to 520 g·in$^2$. In other embodiments, the heel-to-toe moment of inertia Iyy can range from 440 to 460 g·in$^2$, 450 to 470 g·in$^2$, 460 to 480 g·in$^2$, 470 to 490 g·in$^2$, 480 to 500 g·in$^2$, 490 to 510 g·in$^2$, or 500 to 520 g·in$^2$.

T-Shape Design Functions

As discussed above, the embodiment of a hollow golf club head 100 described herein can comprise at least two major components. The metallic, first component 300 comprises the striking portion and a sole extension 500 forming a "T" shape. The non-metallic, second component 200 comprises the rear portion of the crown 110, and wraps around the first component 300 to also comprise a portion of the sole 120. The more dense "T" shaped sole of the first component 300 secured to the less dense wrap around second component 200 can optimize mass properties by reducing the crown mass, and shifting the golf club head center of gravity (CG) lower. The saved weight from the second component 200 can be redistributed to other locations of the golf club head 100 such as the sole extension 500 or the removable weight 600 to further optimize the CG, increase the moment of inertia, and manipulate the shape of the shot trajectory.

The center of gravity of the club head 100 having the first component 300 with the first density and the second component 200 with the second density lower than the first density, can be moved to a lower and greater rearward position compared to an alternate golf club head comprising only a single material with a single density.

EXAMPLES

Example 1: Moment of Inertia and Center of Gravity Location

The two-component club head design comprises a low and rear center of gravity, and an increased moment of inertia (MOI) compared to all metal club heads. The increased MOI can be achieved by increasing the amount of discretionary mass. As described above, increasing discretionary mass can be achieved with a multi-material construction. By having the first component made from a metallic material, and the second component made from a non-metallic material, mass can be removed from the crown and be added to the first component or the removable weight.

Table 1 shows moment of inertia for a club head A, a club head B, a club head 1 (i.e. FIGS. 1-9), and a club head 2 (i.e. FIGS. 1-9). Club head A is an all-metal design configured to provide low spin. Club head 1 is a multiple material design including the first component 300 and the second component 200 configured to provide low spin. Club head B is an all-metal design configured to provide a high moment of inertia. Club head 2 comprises a multiple material design including the first component 300 and the second component 200 configured to provide a high moment of inertia. Club heads A and 1 are similar in terms of design and dimensions (e.g. volume, total mass, shape, loft angle, etc.), but club head A is devoid of multiple materials. Club heads B and 2 are similar in terms of design and dimensions (e.g. volume, total mass, shape, loft angle, etc.), but club head B is devoid of multiple materials. Club heads B and 2 are designed with greater overall moment of inertia values compared to club head designs focused on decreasing golf ball spin. However, greater moment of inertia can be still advantageous across all club head designs.

Comparing the low spin club head designs (i.e. club heads A and 1), the multi material construction of club head 1 comprised a larger Ixx and Iyy value compared to club head A. Club head 1 allowed for greater discretionary mass to repositioned into the first component 300 and the removeable weight 600. Club head 1 allowed for about 8 to 12 grams of crown 110 mass to be repositioned into the removeable weight 600 and the first component 300.

Comparing the high moment of inertia club head designs (i.e. club heads B and 2), the multi material construction of club head 2 comprised a larger Ixx value and a similar Iyy value compared to club head B. Club head 2 allowed for about 8 to 12 grams of crown 110 mass to be repositioned into the removable weight 600 and the first component 300. The multi material construction of club heads 1 and 2 allowed for greater or similar moment of inertia values compared to all metal club head designs. The multi material constructions of club heads 1 and 2 can achieve greater or similar moment of inertia values as all metal club heads, while lowering the center of gravity as described in more detail below.

TABLE 1

Club Head Moment of Inertia

| Club Head | Ixx (g · in$^2$) | Iyy (g · in$^2$) |
|---|---|---|
| Club Head A | 226.4 | 467.5 |
| Club Head 1 | 252.3 | 474.4 |
| Club Head B | 252.8 | 503 |
| Club Head 2 | 283.5 | 501.7 |

Further, the two-component club head design comprises a low and back center of gravity (CG). The two-component club head design can have a CG that is lower and rearward than a club head formed from all metal. As described above, the low and back CG can be achieved by increasing the amount of discretionary mass. Various means to increase the amount of discretionary mass are described throughout this disclosure. One example can be reducing the mass of the crown. The low and back center of gravity can provide advantages such as lowering golf ball spin.

Table 2 shows the center of gravity of location for club head A, club head B, club head 1, and club head 2. In some embodiments, the center of gravity location can be defined with respect to the coordinate system establishing the x-axis 190, y-axis 192, and z-axis 196. In other embodiments, the center of gravity location can be measured from a leading edge (i.e. most forwardmost point on the club head) of the club head when viewed above the ground plane 105. The center of gravity can be measured along the y-axis 192 and is represented by CGy. The center of gravity can be measured along the z-axis 196 and is represented by CGz. Lowering the center of gravity can be achieved by decreasing the distance along the y-axis 192. Moving the center of gravity rearward can be achieved by increasing the distance along the z-axis 196.

Referring to Table 2, the center of gravity location can be compared with respect to their designs. The center of gravity location was compared between the low spin club head designs (i.e. club heads A and 1). Club head A comprised a CGy of 0.477 inch, and club head 1 comprised a CGy of 0.463 inch. Club head A comprised a CGz of 1.235 inch, and club head 1 comprised a CGz of 1.233 inch. Club head 1 comprised a lower center of gravity location along the y-axis 192 compared to all metal club head A. Club head 1 comprised a similar center of gravity location along the z-axis 196 compared to all metal club head A. The multi material construction of club head 1 can achieve a lower center of gravity location compared to an all-metal club head. Further, the multi material construction of club head 1 can still retain a rearward center of gravity location compared to an all-metal club head.

With continued reference to Table 2, the center of gravity location was compared between the high moment of inertia club head designs (i.e. club heads B and 2). Club head B comprised a CGy of 0.485 inch, and club head 2 comprised a CGy of 0.456 inch. Club head 2 comprised a lower center of gravity location along the y-axis 192 compared to all metal club head B. Club head 2 comprised a similar center of gravity location along the z-axis 196 compared to all metal club head B. The multi material construction of club head 2 can achieve a lower center of gravity location compared to an all-metal club head. Further, the multi material construction of club head 2 can still retain a rearward center of gravity location compared to an all-metal club head.

TABLE 2

| Club Head CG Location | | | |
|---|---|---|---|
| Club Head | CGx (inch) | CGy (inch) | CGz (inch) |
| Club Head A | 0.036 | 0.477 | 1.235 |
| Club Head 1 | 0.061 | 0.463 | 1.233 |
| Club Head B | 0.056 | 0.485 | 1.337 |
| Club Head 2 | 0.065 | 0.456 | 1.332 |

Example 2: Golf Ball Spin Control

The two-component club head design comprises a metallic first component 300, and a non-metallic second component 200 to increase the amount of discretionary mass. The non-metallic (e.g. composite) second component 200 allows mass to be moved from the crown, the sole, the heel end, and the toe end to the removeable weight 600, the first component 300, and the mass pad 900. Moving mass into the removeable weight 600 and the mass pad 900 can lower the center of gravity and reduce the amount of spin imparted on a golf ball during impact.

Table 3 shows the club head mass properties for a club head C, a club head D, a club head 3 with a mass pad 900 (FIG. 13), and a club head 4 with a mass pad 905 (FIG. 14). Club head C is an all-metal club head with a mass pad of 13 grams. Club head 3 is a multi-component club head including the first component 300, the second component 200, and the mass pad 900. Club head D is an all-metal club head with a mass pad of 4.2 grams. Club head 4 is a multi-component club head including the first component 300, the second component 200, and the mass pad 905. Club heads C and 3 are similar in terms of design and dimensions (e.g. volume, total mass, shape, loft angle, etc.), but club head C is devoid of multiple materials. Club heads D and 4 are similar in terms of design and dimensions (e.g. volume, total mass, shape, loft angle, etc.), but club head D is devoid of multiple materials. Total discretionary weight can be measured as the combined mass of structures such as ribs, products of inertia, mass pads, removeable weights, heel/hosel structures, and epoxy or liquid injected into the cavity. Other mass can include rib mass, products of inertia, heel/hosel structures, and epoxy or liquid injected into the cavity.

Comparing club heads C and 3, the multi-material construction of club head 3 allowed for a mass pad of 37 grams and a total discretionary weight of 59 grams which resulted in a CGy of 0.425 inch. Club head 3 comprised a greater amount of discretionary weight and a lower center of gravity compared to all metal club head C. The lower center of gravity of club head 3 allowed for a 100 to 200 rpm decrease in golf ball spin compared to club head C. The multi-component construction of club head 3 provides the advantages of increased discretionary weight and lower center of gravity over all metal club head C.

Comparing club heads D and 4, the multi-material construction of club head 4 allowed for a mass pad of 32.7 grams and a total discretionary weight of 56 grams which resulted in a CGy of 0.407 inch. Club head 4 comprised a greater amount of discretionary weight and a lower center of gravity compared to all metal club head D. The lower center of gravity of club head 4 allowed for a 150 to 250 rpm decrease in golf ball spin compared to all metal club head D. The multi-component construction of club head 4 provides the advantages of increased discretionary weight and lower center of gravity over all metal club head D.

Referring to Tables 3 and 4, the moment of inertias were compared between the club heads C, D, 4, and 4. The multiple component club head 3 retained a similar Ixx value and CGz value compared to club head C. The multiple component club head 4 retained a similar Ixx value and CGz value compared to club head D. The multiple component club heads 3 and 4 were able to retain a similar rearward center of gravity position and a similar crown to sole moment of inertia as all metal club heads C and D, but were able to additionally provide a greater amount of discretionary weight to lower golf ball spin.

TABLE 3

| Club Head Mass Properties | | | | | | | |
|---|---|---|---|---|---|---|---|
| Club Head | CGx (inch) | CGy (inch) | CGz (inch) | Mass Pad (grams) | Removeable Weight (grams) | Other mass (grams) | Total Discretionary Weight (grams) |
| Club Head C | 0.056 | 0.485 | 1.337 | 13 | 10 | 21 | 44 |
| Club Head 3 | 0.036 | 0.425 | 1.341 | 37 | 13 | 9 | 59 |
| Club Head D | 0.183 | 0.474 | 1.492 | 4.2 | 10 | 23.5 | 38 |
| Club Head 4 | 0.181 | 0.407 | 1.471 | 32.7 | 13 | 10 | 56 |

TABLE 4

| Club Head Moment of Inertia | | |
|---|---|---|
| Club Head | Ixx ($g \cdot in^2$) | Iyy ($g \cdot in^2$) |
| Club Head C | 253 | 503 |
| Club Head 3 | 250 | 450 |
| Club Head D | 299 | 542 |
| Club Head 4 | 296 | 486 |

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1. A golf club head comprising: a crown, a sole opposite the crown, a heel end, a toe end opposite the heel end, a rear end, and a skirt extending between the crown and the sole; a metallic first component comprising a striking face, a return portion extending rearward from the striking face, and a sole rear extension extending rearward from the return portion; a non-metallic second component configured to be secured to the metallic first component to enclose a hollow interior cavity; wherein the return portion comprises a sole return portion forming a portion of the sole and a crown return portion forming a portion of the crown; wherein the sole rear extension forms a portion of the sole; wherein the sole rear extension comprises a shelf extending vertically from the sole rear extension to support the non-metallic second component at the rear end; wherein the sole return portion and the sole rear extension of the first component form a T-shaped profile; wherein the first component comprises a first component mass, the first component mass comprising 80 percent to 95 percent of a total mass of the golf club head; and wherein the second component comprises a second component mass, the second component mass comprising 3 percent to 15 percent of the total mass of the golf club head.

Clause 2. The golf club head of clause 1, wherein the first component is formed from a stainless steel, and the second component is formed from a filled thermoplastic or fiber-reinforced composite.

Clause 3. The golf club head of clause 1, wherein the sole rear extension comprises a first component perimeter edge extending along the crown return portion, the sole return portion, the sole rear extension, and the shelf; wherein the first component comprises a lip recessed from an outer surface of the first component and extending along the first component perimeter edge; and wherein the second component is configured to be secured to the first component at the lip.

Clause 4. The golf club head of clause 1, wherein the sole rear extension comprises a length ranging from 1.5 inches to 3.5 inches.

Clause 5. The golf club head of clause 1, wherein the shelf comprises a profile in relation to the striking face when viewed from a top view, the shelf profile comprising a convex shape.

Clause 6. The golf club head of clause 1, wherein the sole rear extension comprises a weight port proximate the skirt; wherein the weight port is configured to receive a removable weight; and wherein the removeable weight comprises a weight mass ranging from 10 grams to 25 grams.

Clause 7. The golf club head of clause 1, wherein the golf club head comprises a volume less than 300 cubic centimeters.

Clause 8. A golf club head comprising: a crown, a sole opposite the crown, a heel end, a toe end opposite the heel end, a rear end, and a skirt extending between the crown and the sole; a metallic first component comprising a striking face, a return portion extending rearward from the striking face, and a sole rear extension extending rearward from the return portion; a non-metallic second component configured to be secured to the metallic first component to enclose a hollow interior cavity; wherein the return portion comprises a sole return portion forming a portion of the sole and a crown return portion forming a portion of the crown;

wherein the sole rear extension forms a portion of the sole; wherein the sole rear extension comprises a shelf extending vertically from the sole rear extension to support the non-metallic second component at the rear end; wherein the sole rear extension comprises a first component perimeter edge extending along the crown return portion, the sole return portion, the sole rear extension, and the shelf; wherein the first component comprises a lip recessed from an outer surface of the first component and extending along the first component perimeter edge; wherein the second component is configured to be secured to the first component at the lip; wherein the first component comprises a first component mass, the first component mass comprising 80 percent to 95 percent of a total mass of the golf club head; and wherein the second component comprises a second component mass, the second component mass comprising 3 percent to 15 percent of the total mass of the golf club head.

Clause 9. The golf club head of clause 8, wherein the first component is formed from a stainless steel, and the second component is formed from a filled thermoplastic or fiber-reinforced composite.

Clause 10. The golf club head of clause 8, wherein the sole rear extension comprises a length ranging from 1.5 inches to 3.5 inches.

Clause 11. The golf club head of clause 8, wherein the shelf of the first component forms a portion of the skirt and a portion of the crown.

Clause 12. The golf club head of clause 8, wherein the shelf comprises a profile in relation to the striking face when viewed from a top view, the shelf profile comprising a convex shape.

Clause 13. The golf club head of clause 8, wherein the sole rear extension comprises a weight port proximate the skirt; wherein the weight port is configured to receive a removable weight; and wherein the removeable weight comprises a weight mass ranging from 10 grams to 25 grams.

Clause 14. The golf club head of clause 8, wherein the golf club head comprises a volume less than 300 cubic centimeters.

Clause 15. A golf club head comprising: a crown, a sole opposite the crown, a heel end, a toe end opposite the heel end, a rear end, and a skirt extending between the crown and the sole; a metallic first component comprising a striking face, a return portion extending rearward from the striking face, and a sole rear extension extending rearward from the return portion; a non-metallic second component configured to be secured to the metallic first component to enclose a hollow interior cavity; wherein the return portion comprises a sole return portion forming a portion of the sole and a crown return portion forming a portion of the crown; wherein the sole rear extension forms a portion of the sole; wherein the sole rear extension comprises a shelf extending vertically from the sole rear extension to support the non-metallic second component at the rear end; wherein the shelf of the first component forms a portion of the skirt and a portion of the crown; wherein the shelf comprises a profile in relation to the striking face when viewed from a top view, the shelf profile comprising a convex shape; wherein the first component comprises a first component mass, the first component mass comprising 80 percent to 95 percent of a total mass of the golf club head; and wherein the second component comprises a second component mass, the second component mass comprising 3 percent to 15 percent of the total mass of the golf club head.

Clause 16. The golf club head of clause 15, wherein the first component is formed from a stainless steel, and the second component is formed from a filled thermoplastic or fiber-reinforced composite.

Clause 17. The golf club head of clause 15, wherein the sole rear extension comprises a first component perimeter edge extending along the crown return portion, the sole return portion, the sole rear extension, and the shelf; wherein the first component comprises a lip recessed from an outer surface of the first component and extending along the first component perimeter edge; and wherein the second component is configured to be secured to the first component at the lip.

Clause 18. The golf club head of clause 15, wherein the sole rear extension comprises a length ranging from 1.5 inches to 3.5 inches.

Clause 19. The golf club head of clause 15, wherein the sole rear extension comprises a weight port proximate the skirt; wherein the weight port is configured to receive a removable weight; and wherein the removeable weight comprises a weight mass ranging from 10 grams to 25 grams.

Clause 20. The golf club head of clause 15, wherein the golf club head comprises a volume less than 300 cubic centimeters.

Clause 21. The golf club head of clause 15, wherein the golf club head comprises a mass pad integrally formed with the sole; wherein the mass pad comprises a mass ranging from 30 grams to 40 grams.

Clause 22. The golf club head of clause 21, wherein the mass pad of the golf club head is positioned in a central portion of the sole.

Clause 23. The golf club head of clause 21, wherein the golf club head comprising the metallic first component, the non-metallic second component, and the mass pad comprises a 100 to 200 rpm reduction in golf ball spin compared to a golf club head devoid of the metallic first component, the non-metallic second component, and the mass pad.

Various features and advantages of the disclosure are set forth in the following claims.

What is claimed is:

1. A golf club head comprising:

a crown, a sole opposite the crown, a heel end, a toe end opposite the heel end, a rear end, and a skirt extending between the crown and the sole;

a metallic first component comprising a striking face, a return portion extending rearward from the striking face, and a sole rear extension extending rearward from the return portion;

a non-metallic second component configured to be secured to the metallic first component to enclose a hollow interior cavity;

wherein the return portion comprises a sole return portion forming a portion of the sole and a crown return portion forming a portion of the crown;

wherein the sole rear extension forms a portion of the sole;

wherein the sole rear extension comprises a shelf extending vertically from the sole rear extension;

wherein a vertical lip extends forward the shelf, the vertical lip supports the non-metallic second component at the rear end;

wherein the second component comprises a rear cutout secured to the vertical lip;

wherein the rear cutout comprises a rearward edge configured to abut a forward edge of the shelf within a boundary of the crown;

wherein the sole return portion and the sole rear extension of the first component form a T-shaped profile; and wherein the first component comprises a weight port at a rear end of the sole rear extension and below the shelf, the weight port is configured to receive a removable weight.

2. The golf club head of claim 1, wherein the first component is formed from a stainless steel, and the second component is formed from a filled thermoplastic or fiber-reinforced composite.

3. The golf club head of claim 1, wherein the second component comprises a fiber-reinforced resilient layer and a molded structural layer.

4. The golf club head of claim 3, wherein the fiber-reinforced resilient layer and the molded structural layer comprise a common thermoplastic resin.

5. The golf club head of claim 1, wherein the sole rear extension comprises a first component perimeter edge extending along the crown return portion, the sole return portion, the sole rear extension, and the shelf; wherein the first component comprises a lip recessed from an outer surface of the first component and extending along the first component perimeter edge; and wherein the second component is configured to be secured to the first component at the lip.

6. The golf club head of claim 1, wherein the shelf comprises a shelf profile in relation to the striking face when viewed from a top view, the shelf profile comprising a convex shape.

7. The golf club head of claim 1, wherein the removeable weight comprises a weight mass ranging from 10 grams to 25 grams.

8. A golf club head comprising:

a crown, a sole opposite the crown, a heel end, a toe end opposite the heel end, a rear end, and a skirt extending between the crown and the sole;

a metallic first component comprising a striking face, a return portion extending rearward from the striking face, and a sole rear extension extending rearward from the return portion;

a non-metallic second component configured to be secured to the metallic first component to enclose a hollow interior cavity;

wherein the return portion comprises a sole return portion forming a portion of the sole and a crown return portion forming a portion of the crown;

wherein the sole rear extension forms a portion of the sole;

wherein the sole rear extension comprises a shelf extending vertically from the sole rear extension;

wherein a vertical lip extends forward the shelf, the vertical lip supports the non-metallic second component at the rear end;

wherein the second component comprises a rear cutout secured to the vertical lip;

wherein the rear cutout comprises a rearward edge configured to abut a forward edge of the shelf within a boundary of the crown;

wherein the sole rear extension comprises a first component perimeter edge extending along the crown return portion, the sole return portion, the sole rear extension, and the shelf;

wherein the first component comprises a lip recessed from an outer surface of the first component and extending along the first component perimeter edge;

wherein the second component is configured to be secured to the first component at the lip;

wherein the first component comprises a weight port at a rear end of the sole rear extension and below the shelf, the weight port is configured to receive a removable weight; and wherein the first component comprises a mass pad integrally formed with the sole such that the mass pad increases a thickness of a forward sole portion, the mass pad comprises a mass ranging from 25 grams to 40 grams.

9. The golf club head of claim 8, wherein the first component is formed from a stainless steel, and the second component is formed from a filled thermoplastic or fiber-reinforced composite.

10. The golf club head of claim 8, wherein the second component comprises a fiber-reinforced resilient layer and a molded structural layer.

11. The golf club head of claim 10, wherein the fiber-reinforced resilient layer and the molded structural layer comprise a common thermoplastic resin.

12. The golf club head of claim 8, wherein the shelf of the first component forms a portion of the skirt and a portion of the crown.

13. The golf club head of claim 8, wherein the shelf comprises a shelf profile in relation to the striking face when viewed from a top view, the shelf profile comprising a convex shape.

14. The golf club head of claim 8, wherein the removeable weight comprises a weight mass ranging from 10 grams to 25 grams.

15. The golf club head of claim 8, wherein the mass pad comprises a mass ranging from 30 grams to 40 grams.

16. The golf club head of claim 15, wherein the mass pad is offset from the striking face and positioned in a central portion of the sole.

17. A golf club head comprising:

a crown, a sole opposite the crown, a heel end, a toe end opposite the heel end, a rear end, and a skirt extending between the crown and the sole;

a metallic first component comprising a striking face, a return portion extending rearward from the striking face, and a sole rear extension extending rearward from the return portion;

a non-metallic second component configured to be secured to the metallic first component to enclose a hollow interior cavity;

wherein the return portion comprises a sole return portion forming a portion of the sole and a crown return portion forming a portion of the crown;

wherein the sole rear extension forms a portion of the sole;

wherein the sole rear extension comprises a shelf extending vertically from the sole rear extension;

wherein a vertical lip extends forward the shelf, the vertical lip supports the non-metallic second component at the rear end;

wherein the shelf of the first component forms a portion of the skirt and a portion of the crown;

wherein the shelf comprises a shelf profile in relation to the striking face when viewed from a top view, the shelf profile comprising a convex shape;

wherein the second component comprises a rear cutout secured to the vertical lip;

wherein the rear cutout comprises a rearward edge configured to abut a forward edge of the shelf within a boundary of the crown;

wherein the first component comprises a first component mass, the first component mass comprising 80 percent to 95 percent of a total mass of the golf club head; and wherein the first component comprises a weight port at a rear end of the sole rear extension and below the shelf, the weight port is configured to receive a removable weight.

18. The golf club head of claim 17, wherein the first component is formed from a stainless steel, and the second component is formed from a filled thermoplastic or fiber-reinforced composite.

19. The golf club head of claim 17, wherein the second component comprises a fiber-reinforced resilient layer and a molded structural layer.

20. The golf club head of claim 19, wherein the fiber-reinforced resilient layer and the molded structural layer comprise a common thermoplastic resin.

* * * * *